US006032438A

United States Patent [19]

Sanfilippo et al.

[11] Patent Number: 6,032,438

[45] **Date of Patent: *Mar. 7, 2000**

[54] APPARATUS AND METHOD FOR REPLACING ENVIRONMENT WITHIN CONTAINERS WITH A CONTROLLED ENVIRONMENT

[76] Inventors: James J. Sanfilippo, 505 N. Lake Shore Dr./Suite 6806, Chicago, Ill. 60611; John E. Sanfilippo, P.O. Box 952, Barrington, Ill. 60011

[ * ] Notice: This patent is subject to a terminal disclaimer.

[21] Appl. No.: 08/673,241

[22] Filed: Jun. 26, 1996

Related U.S. Application Data

[63] Continuation-in-part of application No. 08/643,821, May 7, 1996, Pat. No. 5,816,024, which is a continuation-in-part of application No. 08/394,345, Feb. 21, 1995, abandoned, which is a continuation-in-part of application No. 08/245,249, May 17, 1994, abandoned, which is a continuation-in-part of application No. 08/122,388, Sep. 16, 1993, Pat. No. 5,417,258.

[51] Int. Cl.[7] ..... B65B 31/02

[52] U.S. Cl. ..... 53/432; 53/510; 141/4; 141/70; 141/129; 141/286

[58] Field of Search ..... 53/510, 511, 512, 53/432, 434, 403, 110, 79, 87; 141/4, 11, 67, 70, 129, 286

[56] References Cited

U.S. PATENT DOCUMENTS

| | | |
|---|---|---|
| 268,477 | 12/1882 | Fish . |
| 789,699 | 5/1905 | Lorenz . |
| 1,406,380 | 2/1922 | Heath et al. . |
| 1,639,828 | 8/1927 | Wheeler et al. . |
| 1,928,903 | 10/1933 | Manning . |
| 1,940,013 | 12/1933 | Petersen . |
| 2,131,876 | 7/1938 | Hurst . |
| 2,140,187 | 12/1938 | Kantor . |
| 2,199,565 | 5/1940 | Kantor . |
| 2,227,190 | 12/1940 | Kronquest . |
| 2,240,655 | 5/1941 | Kronquest . |
| 2,363,799 | 11/1944 | Boyd et al. . |

(List continued on next page.)

FOREIGN PATENT DOCUMENTS

| | | |
|---|---|---|
| 59122/94 | 3/1995 | Australia . |
| 54743/96 | 8/1996 | Australia . |
| 447131 | 3/1948 | Canada . |
| 463300 | 2/1950 | Canada . |
| 1309992 | 9/1989 | Canada . |
| 33 23 710 A1 | 10/1985 | Germany . |
| 0139313 | 5/1990 | Japan . |
| 551271 | 2/1943 | United Kingdom . |
| 2 086 834 | 5/1982 | United Kingdom . |
| 2 217 672 | 11/1989 | United Kingdom . |
| WO 95/31375 | 11/1995 | WIPO . |

*Primary Examiner*—Joseph J. Hail, III
*Assistant Examiner*—Ed Tolan
*Attorney, Agent, or Firm*—Brinks Hofer Gilson & Lione

[57] ABSTRACT

A controlled environment gassing system is provided for removing the existing environment from containers. The existing environment may be purged by passing the containers along a gas distribution manifold disposed parallel to the direction of travel of the containers. The manifold includes at least one region of flow resistance disposed parallel to the direction of travel, and the manifold may have a width less than the width of the container and/or screen openings sized to provide a laminarized flow, for supplying a controlled environment gas flushing stream continuously and at substantially steady state to the containers. As the containers pass along the manifold, the controlled environment flushing gas creates an optimal flow pattern which consistently and steadily removes the existing environment from the containers while preventing the flushing gas from drawing in air. Return gas chambers are provided to retrieve the gasses exiting the container as they are purged. Sidewalls may be provided along longitudinal sides of the chamber to increase system efficiency.

50 Claims, 14 Drawing Sheets

U.S. PATENT DOCUMENTS

| | | | |
|---|---|---|---|
| 2,439,773 | 4/1948 | Hohl et al. . | |
| 2,519,353 | 8/1950 | Cassady . | |
| 2,521,746 | 9/1950 | Preis . | |
| 2,534,305 | 12/1950 | Sharf . | |
| 2,630,958 | 3/1953 | Hohl . | |
| 2,649,671 | 8/1953 | Bartelt . | |
| 2,660,352 | 11/1953 | Renard . | |
| 2,768,487 | 10/1956 | Day et al. . | |
| 2,869,301 | 1/1959 | Stover . | |
| 2,978,336 | 4/1961 | Morrison . | |
| 3,056,244 | 10/1962 | Bartels . | |
| 3,087,823 | 4/1963 | Hein et al. . | |
| 3,103,771 | 9/1963 | Gräfingholt . | |
| 3,117,873 | 1/1964 | Bartels et al. . | |
| 3,220,153 | 11/1965 | Cormack, Jr. et al. . | |
| 3,220,157 | 11/1965 | Buchner . | |
| 3,340,668 | 9/1967 | Bofinger . | |
| 3,347,534 | 10/1967 | Dawson . | |
| 3,415,310 | 12/1968 | Kulhmann . | |
| 3,466,841 | 9/1969 | Rausing . | |
| 3,486,295 | 12/1969 | Rausing et al. . | |
| 3,488,915 | 1/1970 | Delestatius . | |
| 3,508,373 | 4/1970 | Robinson, Jr. . | |
| 3,511,022 | 5/1970 | Finley et al. . | |
| 3,545,160 | 12/1970 | Jantze et al. . | |
| 3,556,174 | 1/1971 | Gibble . | |
| 3,584,661 | 6/1971 | Riesenberg . | |
| 3,619,975 | 11/1971 | Johnson et al. . | |
| 3,676,673 | 7/1972 | Coleman . | |
| 3,708,952 | 1/1973 | Schulze et al. . | |
| 3,747,296 | 7/1973 | Zausner . | |
| 3,789,888 | 2/1974 | James et al. . | |
| 3,807,052 | 4/1974 | Troue . | |
| 3,837,137 | 9/1974 | Yatsushiro et al. . | |
| 3,860,047 | 1/1975 | Finkelmeier et al. . | |
| 3,861,116 | 1/1975 | Domke . | |
| 3,871,157 | 3/1975 | Domke et al. . | |
| 3,881,300 | 5/1975 | Zetterberg . | |
| 3,910,009 | 10/1975 | Canfield . | |
| 3,936,950 | 2/1976 | Troue . | |
| 3,939,287 | 2/1976 | Orwig et al. . | |
| 3,942,301 | 3/1976 | Domke . | |
| 4,014,153 | 3/1977 | Wilson . | |
| 4,014,158 | 3/1977 | Rausing . | |
| 4,016,705 | 4/1977 | Wilson et al. . | |
| 4,027,450 | 6/1977 | Chiu et al. . | |
| 4,094,121 | 6/1978 | Ganholt . | |
| 4,140,159 | 2/1979 | Domke | 53/510 |
| 4,148,933 | 4/1979 | Janovtchik . | |
| 4,154,044 | 5/1979 | Lang . | |
| 4,458,734 | 7/1984 | Scholle et al. . | |
| 4,498,508 | 2/1985 | Scholle et al. . | |
| 4,588,000 | 5/1986 | Malin et al. . | |
| 4,602,473 | 7/1986 | Hayashi et al. . | |
| 4,658,566 | 4/1987 | Sanfilippo . | |
| 4,696,226 | 9/1987 | Witmer . | |
| 4,703,609 | 11/1987 | Yoshida et al. | 53/431 |
| 4,733,818 | 3/1988 | Aghnides . | |
| 4,768,326 | 9/1988 | Kovacs . | |
| 4,791,775 | 12/1988 | Raque et al. . | |
| 4,823,680 | 4/1989 | Nowotarski . | |
| 4,827,696 | 5/1989 | Arends et al. . | |
| 4,831,811 | 5/1989 | Nixon, Jr. et al. . | |
| 4,905,454 | 3/1990 | Sanfilippo et al. . | |
| 4,941,306 | 7/1990 | Pfaffmann et al. . | |
| 4,962,777 | 10/1990 | Bell . | |
| 4,964,259 | 10/1990 | Yivisaker et al. . | |
| 4,982,555 | 1/1991 | Ingemann . | |
| 4,996,071 | 2/1991 | Bell . | |
| 5,001,878 | 3/1991 | Sanfilippo et al. | 53/510 |
| 5,020,303 | 6/1991 | Vokins . | |
| 5,054,265 | 10/1991 | Perigo et al. . | |
| 5,069,020 | 12/1991 | Sanfilippo et al. . | |
| 5,071,667 | 12/1991 | Grüne et al. . | |
| 5,121,590 | 6/1992 | Scarnan | 53/510 |
| 5,159,799 | 11/1992 | Rising et al. . | |
| 5,178,841 | 1/1993 | Vokins et al. | 53/432 |
| 5,201,165 | 4/1993 | Marano et al. . | |
| 5,228,269 | 7/1993 | Sanfilippo et al. . | |
| 5,230,203 | 7/1993 | Wu et al. . | |
| 5,247,746 | 9/1993 | Johnson et al. | 53/432 |
| 5,323,589 | 6/1994 | Linner | 53/432 |
| 5,371,998 | 12/1994 | Johnson et al. . | |
| 5,417,255 | 5/1995 | Sanfilippo et al. | 141/1 |
| 5,452,563 | 9/1995 | Marano et al. . | |
| 5,473,860 | 12/1995 | Linner . | |
| 5,481,852 | 1/1996 | Mitchell | 53/510 |
| 5,540,557 | 7/1996 | Carson | 53/510 |
| 5,682,723 | 11/1997 | Nowotarski et al. . | |

APPARATUS AND METHOD FOR REPLACING ENVIRONMENT WITHIN CONTAINERS WITH A CONTROLLED ENVIRONMENT

RELATED APPLICATIONS

This application is a continuation-in-part of application Ser. No. 08/643,821 filed May 7, 1996, now U.S. Pat. No. 5,816,024 application Ser. No. 08/394,345 filed Feb. 21, 1995 now abandoned; which in turn is a continuation-in-part of application Ser. No. 08/245,249 filed May 17, 1994 now abandoned, which in turn is a continuation-in-part of application Ser. No. 08/122,388 filed Sep. 16, 1993 and issued May 23, 1995, U.S. Pat. No. 5,417,255, the entire disclosures of which are incorporated herein by reference.

FIELD OF THE INVENTION

The invention relates to improved apparatus and method for removing the existing environment from within a container and replacing it with a controlled environment. More particularly, this invention relates to improved apparatus and process for replacing air in containers which includes packages, cans, pouches, jars, bottles, bags, trays, cartons, or any other conventional packaging, with a desired controlled environment which includes inert gas, combinations of gases and other aromas, mists, moisture, etc.

BACKGROUND OF THE INVENTION

Various techniques for replacing the existing environment in containers for food product and other atmospheric sensitive products, such as some electronic devices or reactive metals are known in the art. Various methods exist for removing oxygen in food filling processes. Such processes are used, for example, in the packaging of nuts, coffee, powdered milk, cheese puffs, infant formula, beverages and various other types of food product. Typically, food containers are exposed to a inert gas flush and/or vacuum for a period of time, subsequent to filling but prior to sealing. The product may also be flushed with a inert gas prior to filling, or may be flushed after the filling process. When the oxygen has been substantially removed from the food contents therein, the containers are sealed, with or without vacuum.

A gas flushing apparatus for removing oxygen from food containers is disclosed in U.S. Pat. No. 4,140,159, issued to Domke. A conveyor belt carries the open top containers in a direction of movement directly below a gas flushing device. The gas flushing device supplies inert gas to the containers in two ways. First, a layer or blanket of low velocity flushing gas is supplied to the entire region immediately above and including the open tops of the containers through a distributing plate having a plurality of small openings. Second, each container is purged using a high velocity flushing gas jet supplied through a plurality of larger jet openings arranged side-by-side in a direction perpendicular to the direction of movement of the food containers. As the containers move forward, in the direction of movement, the steps of inert gas blanketing followed by jet flushing can be repeated a number of times until sufficient oxygen has been removed from the containers, and from the food contents therein.

One aspect of the apparatus disclosed in Domke is that the flow of gas in a container is constantly changing. The high velocity streams are directed through perpendicular openings in a plate, which creates eddies near the openings causing turbulence which may pull in outside air. Similarly, plate openings oriented perpendicular to the direction of the moving containers is disclosed in U.S. Pat. No. 2,630,958 to Hohl. As a container moves past the perpendicular row of high velocity jets, the jets are initially directed downward into the container at the leading edge of the container open top. As the container moves further forward, the flushing gas is directed into the center and, later, into the trailing edge of the open top, after which the container clears the row of jets before being exposed to the next perpendicular row of jets. The process is repeated as the container passes below the next row of jets.

The apparatus disclosed in Domke is directed at flushing empty containers and, in effect, relies mainly on a dilution process to decrease oxygen levels. One perpendicular row of jets per container pitch is inadequate to efficiently remove air contained in food product.

Constantly changing jet patterns in prior art devices create turbulence above and within the containers, which can cause surrounding air to be pulled into the containers by the jets. This turbulence also imposes a limitation on the speed at which the containers pass below the jets. As the containers move faster beneath the jets, the flow patterns within the containers change faster, and the turbulence increases. Also, at high line speeds, purging gas has more difficulty going down into the containers because of the relatively shorter residence time in contact with each high velocity row. The purging gas also has a greater tendency to remain in the headspace above the containers. In addition, a perpendicular arrangement of jets relative to the direction of container travel causes much of the jet to be directed outside the containers, especially when the containers are round. Moreover, the spacing apart of the perpendicular rows may further vary the flow pattern and pull outside air into the containers.

Attempts have also been made to remove oxygen from the headspace of containers. One such flushing device is disclosed in U.S. Pat. No. 5,452,563, issued to Marano et al. One problem with this device is that it requires large quantities of inert gas to reduce the oxygen levels to less than one percent. Preferably, the Marano device may require inert gas of at least 60 times the headspace volume of a filled milk carton, or seven times the volume of an empty carton to reduce the oxygen content to less than one percent. These inefficiencies may be caused in part by the design of Marano device which provides a hood with a 1 inch diameter circular opening to allow gas to flow into the containers moving along a conveyer. As with Domke, a sustained optimal flow pattern cannot be achieved and maintained with this design because the flow pattern is constantly being altered by the position of the container as it moves under the circular opening. The design also provides for a recessed area formed in the hood which acts to trap inert gas and exiting gas within the recessed area. This design will also slow the exit of gas from the container, and thus must rely in part on dilution to achieve its reduced oxygen levels. Accordingly, the Marano design which is directed toward using a high volume of inert gas to cover the entire container opening alters an optimal flow pattern that would efficiently sweep the oxygen from the container. Moreover, the large volumes of purging gases required by this process, which may include carbon dioxide, may violate OSHA requirements and present health problems.

Some other existing gassing systems require the gassing system to move with the container, and may require contact with the container. These systems require moving parts which leads to substantial maintenance and various other safety and operational problems.

It would be desirable to have an efficient gassing system to replace the existing atmospheric environment within empty or filled containers. It would also be desirable to have a system without moving parts that would be easy and efficient to maintain and operate. It would also be desirable to have a system to collect the gases exiting the containers as they are flushed.

SUMMARY OF THE INVENTION

The present invention is an apparatus and method for replacing the existing environment from within containers with a controlled environment. A controlled environment gas stream is passed through a longitudinally oriented region of flow resistance in a distribution chamber to maintain a substantially consistent flow pattern so that an outflowing gas stream is continually replaced by the incoming gas stream while preventing outside environment from being pulled into the container. The invention accordingly substantially reduces the changing gas flow patterns in the containers, significantly reduces turbulence caused by the purge, minimizes the effects of line speed on the turbulence, and permits a steady flow of controlled environment gas to enter the containers causing constant and efficient displacement of the gas environment in the containers. A single source of gas is supplied to a manifold located along, and parallel to, a row of open top containers being transported by a conveyor. The manifold has at least one flow region for providing a steady flow of controlled environment gas into the containers. The manifold may have at least two areas of different flow resistance, with one flow resistance being higher than the other to provide a constant differential flow across the container opening.

The area of higher flow resistance imparts a relatively low velocity flow of controlled environment gas to the open tops of the moving containers and forms a controlled environment gas blanket adjacent the container open tops. The lower velocity controlled environment gas can be supplied substantially at steady state so that there is no interruption or significant fluctuation in the controlled environment gas blanket supplied to each container, as the container moves along the manifold. This is accomplished by providing the area of higher flow resistance along the manifold, parallel to the direction of travel of the containers.

The area of lower flow resistance imparts a relatively high flow of controlled environment gas to the open tops of the containers, sufficient to flush the existing gaseous environment, including, for example, residual oxygen out of the containers. The area of lower flow resistance is adjacent the area of higher flow resistance on the manifold and, preferably, is between two areas of higher flow resistance. When arranged in this fashion, the two areas of lower velocity (higher resistance) flow help prevent the area of higher velocity (lower resistance) flow from drawing in outside air. The higher velocity controlled environment can also be supplied substantially at steady state so that there is no interruption or significant fluctuation in the controlled environment gas flush supplied to each container, as the container moves along the manifold. This is accomplished by providing the area of lower flow resistance along the manifold, parallel to the direction of travel of the container.

Because the lower flow controlled environment gas blanket and higher flow controlled environment gas flush are supplied without significant interruption even as the containers travel, the flow patterns within the containers remain relatively constant throughout the duration of the containers' travel along the manifold. The flow pattern variation above and within the containers is thereby minimized, causing a corresponding minimization in the surrounding air pulled into the containers by the purge. Furthermore, increased line speeds do not affect the flow patterns within the containers, allowing higher line speeds without compromising the quality of the purge. Also, the tendency of higher velocity purging gas to go down into the containers is not significantly reduced as the line speed is increased. Even greater line speeds can be achieved using longer manifolds or multiple manifolds in series to increase the effective length.

With the foregoing in mind, it is a feature and advantage of the invention to provide a gas purging apparatus and method which achieves an optimal controlled environment gas flow pattern within the container with a differential flow using a single source of gas, a common manifold, and a simple construction, thereby reducing cost and space requirements.

It is also a feature and advantage of the invention to provide an optimal controlled environment gas flow pattern within the container with a differential flow gas purging apparatus and method which reduces the controlled environment gas usage to a minimum.

It is also a feature and advantage of the invention to provide an optimal controlled environment gas flow pattern within the container with a differential velocity gas purging apparatus and method which operates substantially at steady state, without interruption, thereby reducing the tendency of the stream to pull air into the containers from the surrounding atmosphere, and allowing a steady flow of controlled environment gas into the containers, causing a constant net outflow of residual air.

It is also a feature and advantage of the invention to provide an optimal controlled environment gas flow pattern within the container with a differential flow gas purging apparatus and method which permits a significant increase in line speeds without compromising the quality of the purge.

It is also a feature and advantage of the invention to provide a manifold with a single flow resistance region that would extend parallel to the direction of container travel and be substantially continuous and have a width less than the width of the container opening, and achieve an optimal controlled environment gas flow pattern within the container with a single velocity substantially laminarized flow that would conserve the controlled environment gas and provide for an efficient purge without pulling in outside oxygen.

It is also a feature and advantage of the invention to provide a manifold having a width less than half the width of the container opening, and achieving an optimal controlled environment gas flow pattern within the container with a substantially continuous flow along the conveyer as the container is transported between packaging stations.

It is also a feature and advantage of the invention to provide a screened manifold having screen openings sized to achieve an optimal controlled environment gas flow pattern within the container with a substantially laminarized flow.

It is also a feature and advantage of this invention to provide a gassing system with no moving parts to allow efficient and safe assembly, maintenance, and operation.

It is also a feature and advantage of the invention to provide return gas system to retrieve gas exiting the container for potential reuse in other areas of the flushing operation.

It is also a feature and advantage of the invention to provide sidewalls and/or bottom walls contiguous or adjacent to the sides of the distribution chamber to provide a more efficient flushing operation.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended Claims and equivalents thereof.

DETAILED DESCRIPTION OF THE PRESENTLY PREFERRED EMBODIMENTS

Figure 1:
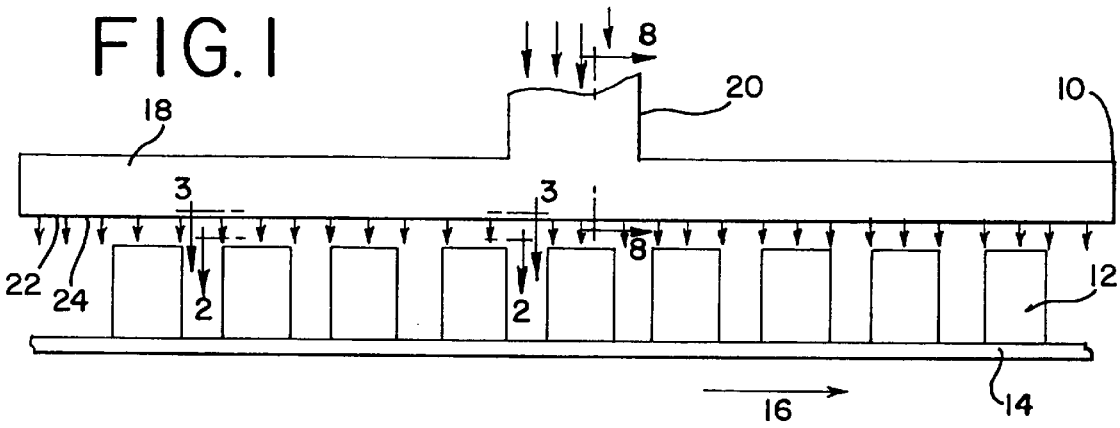
FIG. 1 is a side view of a gas purging apparatus of the invention, longitudinally disposed along a row of open-top containers being transported by a conveyor.
Figure 2:
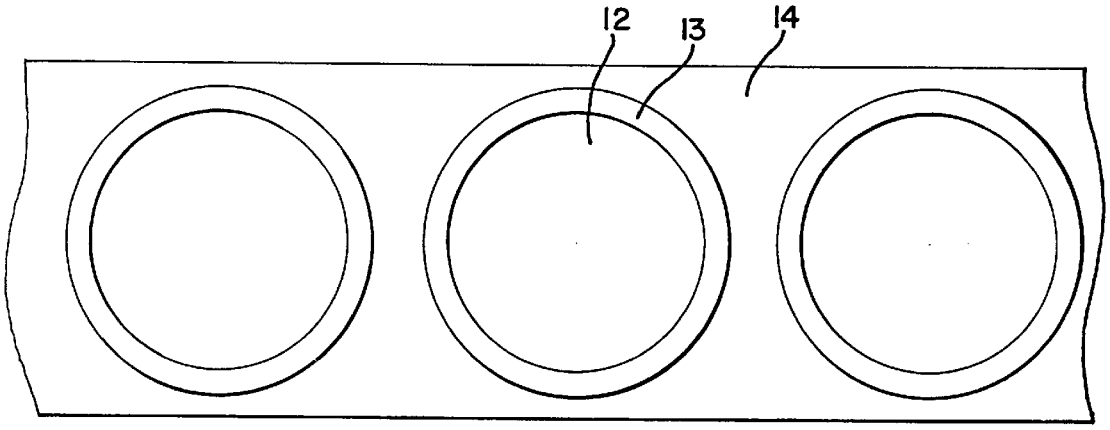
FIG. 2 is taken along the line 2—2 in FIG. 1 and shows the containers and the conveyor from the top.
Figure 3:
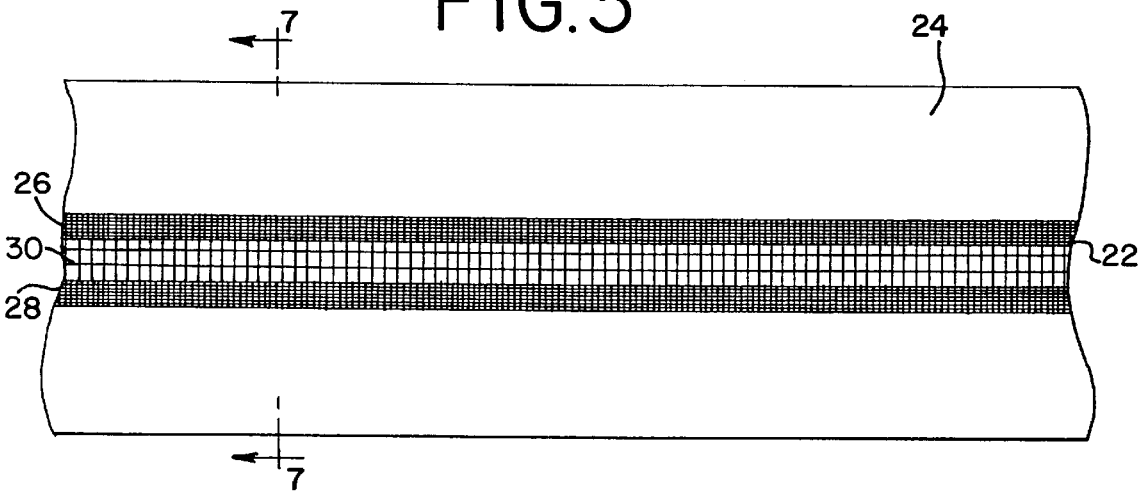
FIG. 3 is a sectional view of the apparatus of FIG. 1, taken along the line 3—3 in FIG. 1 and showing the gas distribution manifold.

Referring to FIGS. 1–3, a gas purging apparatus 10 of the invention is disposed along and above a row of open-top containers 12 traveling on a conveyor 14 along the apparatus 10 in a direction of travel designated by arrow 16. The term "conveyer" as used herein includes various conventional belt conveyers, and any other means of moving containers relative to a stationary gas purging apparatus. Although the gas purging apparatus or rail 10 will most often be used to purge containers moving along a conveyer, it is contemplated that the rail may be used in purging stationary containers, for example, in container holding areas, or other generally stationary processing or packaging areas. The gas purging apparatus 10 includes a longitudinal chamber 18 having an inlet 20 for receiving controlled environment gas from a single source (not shown) to provide a controlled environment, and a distribution manifold 22 for distributing controlled environment gas to the open top containers. The distribution manifold 22 is located on a bottom surface 24 of the chamber 18, longitudinally oriented with respect to the chamber 18, parallel to the conveyor 12 and parallel to the direction of travel 16 of the containers 12.

Figure 30:
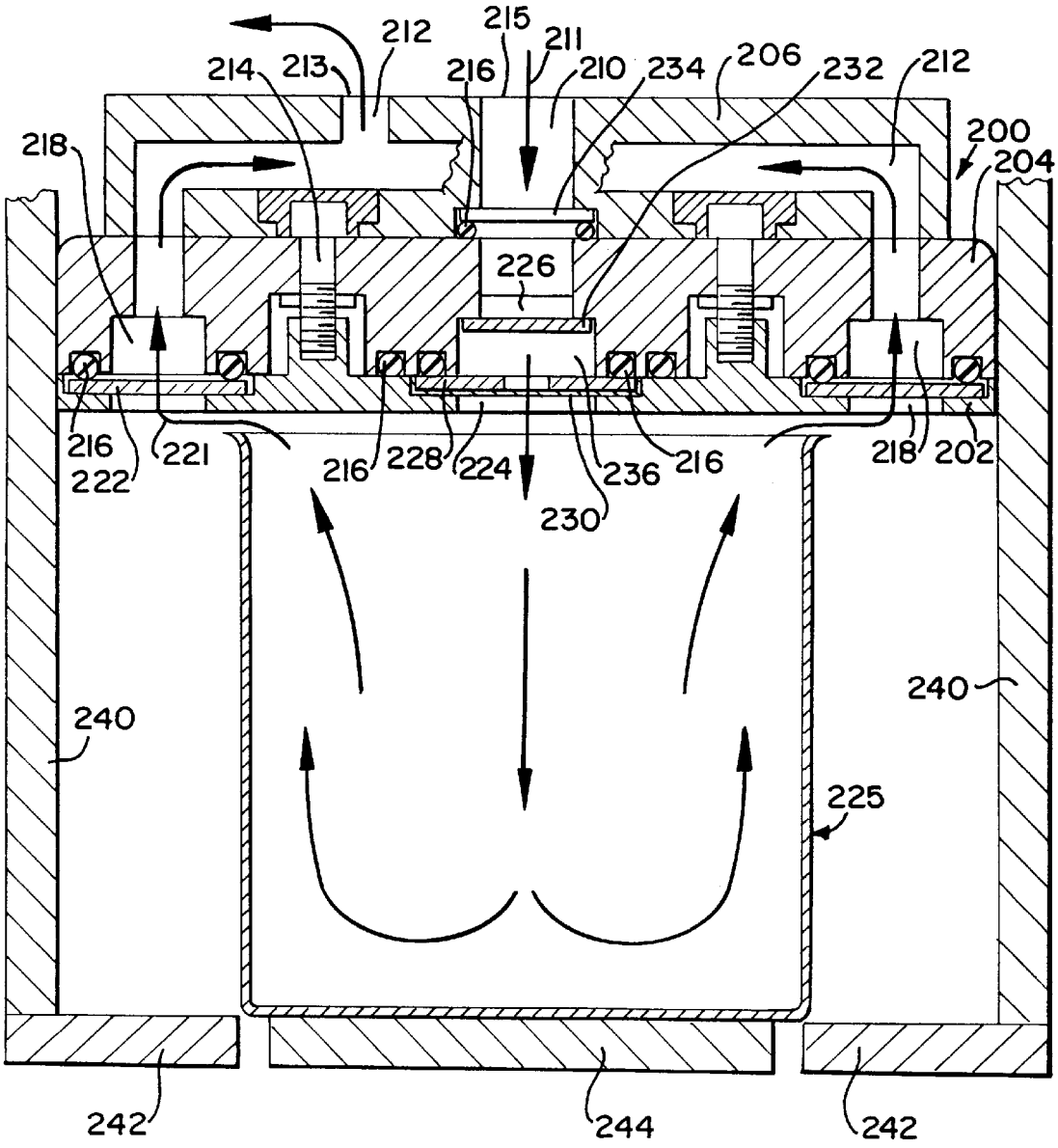
FIG. 30 is a front sectional view of a single empty container being purged with an alternative preferred gassing rail and return gas system with optional sidewalls and bottom walls.

Preferably, the manifold 22 should be adjacent the tops 13 of the open top containers 12. The vertical distance between the manifold 22 and tops 13 is small, and should not exceed about 1 inch, and preferably not 0.375 inches for the embodiment of FIGS. 1–3. More preferably, for the embodiments shown this vertical distance is between about 0.125 and about 0.250 inches, most preferably between about 0.175 and about 0.200 inches. Depending on whether the purpose of purge is to remove oxygen or maintain pre-purged oxygen levels, there could be other optimal distances. As the vertical distance is increased an increased flow of controlled environment gas is needed to overcome drafts and other environmental conditions which might disturb the controlled environment above and in the containers. As shown in FIG. 30, the use of sidewalls 240 and/or bottom walls 242, which may be used with any embodiments of the invention, act to shut out these environmental conditions and may allow the operator to increase the vertical distance with a lessened effect on the optimal flow pattern and need for increased usage of controlled environment.

In the embodiment of FIGS. 1–3, the chamber 18 has a height of about 1.0 inch, a length of about 4 feet, and a width of about 5.0 inches. Each of the containers 12 is a standard 401×502 container having a height of about 5.125 inches and an outer diameter of about 4.0625 inches. The controlled environment is maintained using an inlet and an outlet gas flow rate of about 2 to about 15 cubic feet per minute, for this embodiment. The optimum controlled environment gas flow rate will vary depending on the lines speed and container dimensions.

Preferably, the chamber 18 is closed except for the inlet 20 and the distribution manifold 22. The chamber 18 may be rectangular as shown in FIG. 1, and may be constructed of stainless steel, aluminum, rigid plastic or any other rigid material. The chamber 18 should preferably have a width covering at least about 75 percent of the container opening width, and more preferably at least about as wide as the width of the container openings. The chamber may have a width narrower than 75 percent of the container opening, however, as the width of the chamber 18 is decreased, it becomes more difficult to maintain the optimal flow pattern and the system becomes less efficient requiring increased usage of controlled environment gas. The length of the chamber 18 may vary depending on the desired line speed and minimum residence time underneath the chamber 18 for each container 12.

Also, a plurality of chambers 18 may be arranged lengthwise in series to create a higher "effective" length. For a given residence time, the maximum line speed increases as the length of the chamber 18 is increased. For the embodiment described above, the preferred line speed is about 250 containers per minute (145 feet per minute of conveyor) and requires approximately 12 feet of effective chamber length.

Referring to FIG. 3, a preferred distribution manifold 22 includes a longitudinally oriented center area 30 of lower flow resistance in between and adjacent to two smaller longitudinally oriented areas 26 and 28 of higher flow resistance. For this embodiment, each of the flow regions 26, 28 and 30 extends the length of the bottom surface 24 of the chamber 18, is positioned above the open tops 13 of containers 12, and is oriented parallel to the direction of travel 16 of containers 12. Other types of chamber arrangements may also be utilized, including chambers, which may run in an upward and/or downward direction. In a preferred embodiment, the overall width of the distribution manifold 22 is smaller than the width of the bottom surface 24, and the diameter of the containers 12, with the remainder of the bottom surface 24 being closed. This not only reduces the controlled environment gas quantities and costs needed to maintain the controlled environment, but also improves the quality of the purge by providing a very desirable flow pattern, discussed below. For example, controlled environment gas usage as a percentage of the headspace or container volume may be reduced to about one third the inert gas usage disclosed in U.S. Pat. No. 5,452,563 issued to Marano et al.

In the embodiment shown in FIG. 3, for instance, the bottom surface 24 of the chamber 18 may have a width of about 5.0 inches as described above. The manifold 22, by comparison, may have an overall width of about one inch for containers having opening diameters of about 4–6 inches. The central region 30 of lower flow resistance may have a width of about 0.25 inch, and the surrounding regions 26 and 28 of higher flow resistance may each have a width of about 0.375 inch. Smaller containers may utilize smaller optimum manifold widths. For containers having opening diameters of about 2–3 inches, the manifold may, for example, have an overall width of 0.5 inches, with correspondingly smaller widths for the regions of higher and lower flow resistance.

Figure 7:
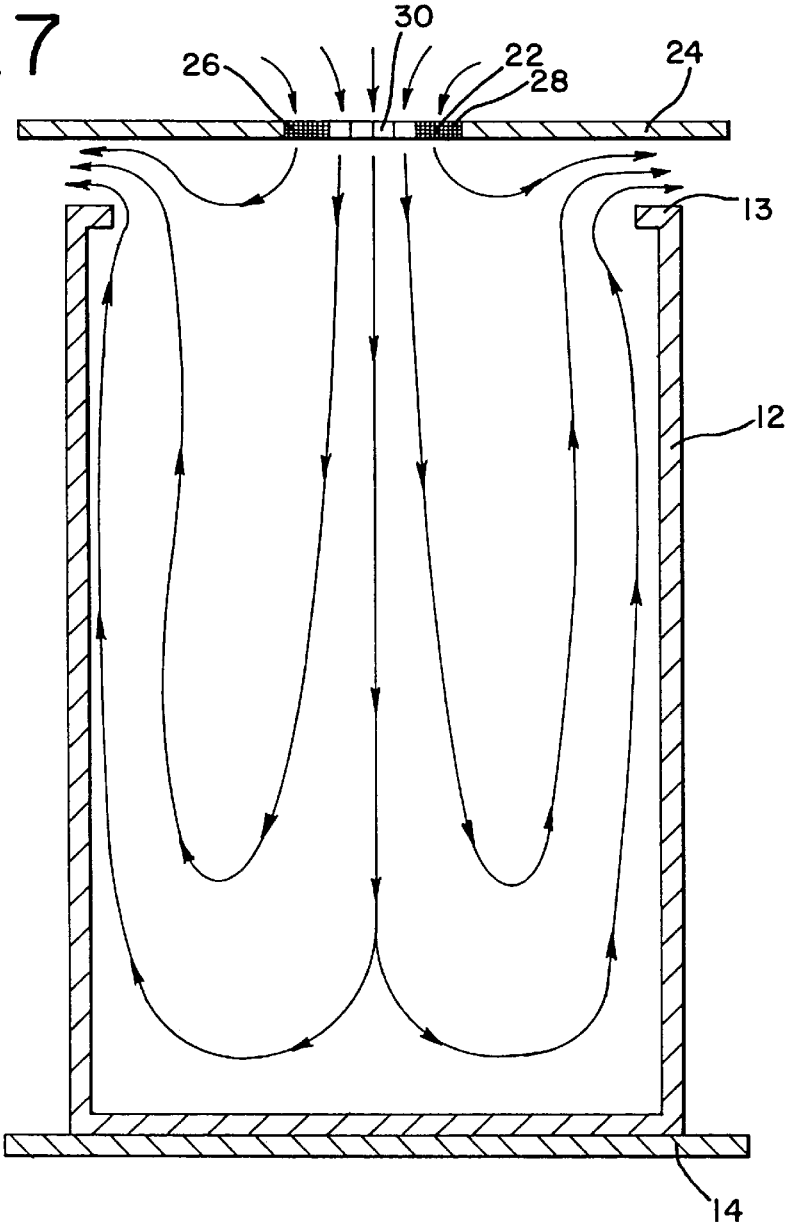
FIG. 7 is a front sectional view of a single container being purged, taken along line 7—7 in FIG. 3.

Preferably, the distribution manifold 22 is positioned longitudinally in the center of the bottom surface 24 and exactly over the centers of moving containers 12 as shown in FIG. 7. Controlled environment gas passing through the center area 30 of lower flow resistance has a relatively high velocity, sufficient to carry the gas to the bottom of each container 12, then up and out as shown by the arrows. Controlled environment gas passing through adjacent regions 26 and 28 of higher flow resistance may be partially carried into the containers 12 by entraining from the higher velocity gas. Otherwise, the gas passing through areas 26 and 28 has a lower velocity, and creates a controlled environment gas blanket covering the tops of containers 12. This controlled environment gas blanket 12 surrounds the higher velocity controlled environment gas stream passing from the region 30 on both sides, protecting the higher velocity stream from mixing with surrounding air.

As shown in FIG. 7, the flow patterns caused by injecting the higher velocity controlled environment gas centrally through region 30 of manifold 22, act in cooperation with the controlled environment gas blanket originating from regions 26 and 28 of manifold 22, to cause a strong positive outflow of controlled environment gas (and any air from the container carried with it) through the space between the surface 24 of chamber 18 and the rims 13 of containers 12. Because the regions 26, 28 and 30 are oriented parallel to the direction of travel of the containers 12, the gas flow patterns (including the outflow) exist continuously and substantially at steady state for the entire time that each container 12 remains underneath the surface 24 of chamber 18. Therefore, there is no opportunity for air to enter the containers 12 from the outside. The existing environment inside the containers 12 steadily decreases as each container moves below the manifold 22 until the desired controlled environment is achieved, whereby the purging is considered completed.

The regions 26, 28 and 30 of high and low flow resistance can be created using adjacent welded screens of different opening size (FIG. 8), selectively layered screens (FIG. 11), porous plastic (e.g. porous high molecular weight high density polyethylene), porous plates, or any selectively porous material that acts as a diffuser. The desired differential flow pattern may be created with stepped or continuous resistance regions oriented transverse to the movement of containers along the manifold. The optimal differential flow region will differ based on various factors including the container size, product, line speed, and desired controlled environment.

Figure 8:
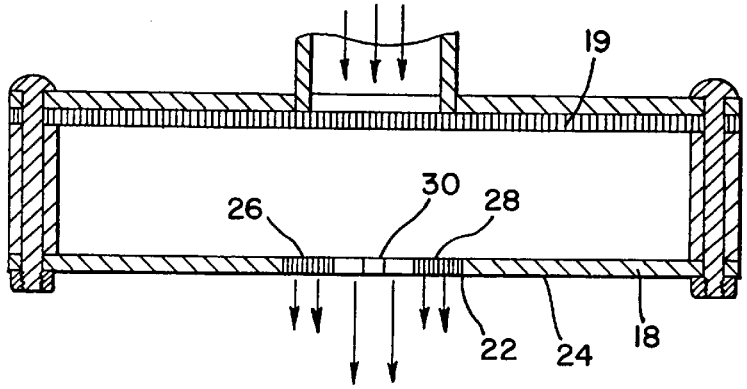
FIG. 8 is a sectional view of a distribution chamber, taken along line 8—8 in FIG. 1.

In the embodiment shown in FIG. 8, the 0.25-inch wide center region 30 can be formed of a 2-ply wire screen having a hole size of 80 microns, with 0.25-inch wide, 3-inch long slots formed in the center parallel to the direction of container travel. The slots can be spaced about 0.75 inch apart from each other, similar to the slots 37 in FIG. 4. This center region 30 can be welded to adjacent regions 26 and 28, each 0.375 inch wide, each being formed from a 5-ply wire screen having a hole size of 40–100 microns. As explained above, this particular manifold 22, having a total width of 1.0 inch, is more suitable for flushing wider containers having opening diameters of 4–6 inches.

Figure 11:
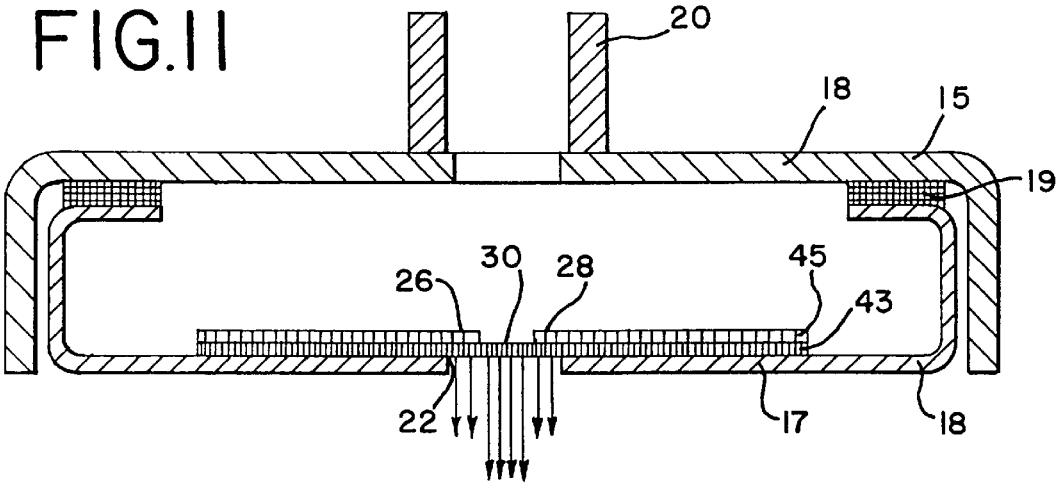
FIG. 11 is a second alternative embodiment of the distribution chamber shown in FIG. 8.

In the embodiment shown in FIG. 11, the screens are selectively layered to form a 0.187-inch wide center region 30 of lower flow resistance and adjacent regions 26 and 28 of higher flow resistance, each of the regions 26 and 28 having a width of 0.156-inch. As explained above, this particular manifold 22, having a total width of 0.5 inches, is most suitable for flushing narrower containers having opening diameters of 2–3 inches. A lower layer 43 of screen can be formed from a 2-ply wire screen having an opening size of 80 microns. An upper layer 45 of screen can be formed from a 5-ply wire screen having an opening size of 40–100 microns. The screen layers 43 and 45 cooperate in the regions 26 and 28 to cause the higher flow resistance. In the region 30 of lower flow resistance, only the screen layer 43 operates, with the layer 45 being broken as shown. Alternatively, the layer 45 may be formed with slots, similar to the slots 37 of FIG. 4, in the region 30.

Figure 9:
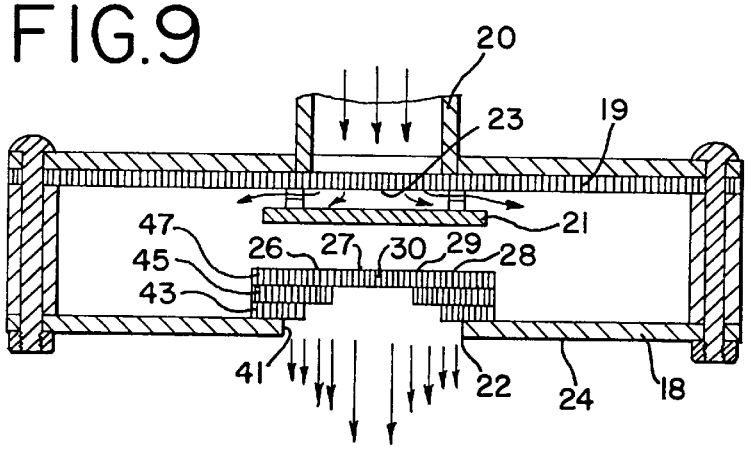
FIG. 9 is an alternative embodiment of the distribution chamber shown in FIG. 8, showing three areas of different flow resistance.
Figure 10:
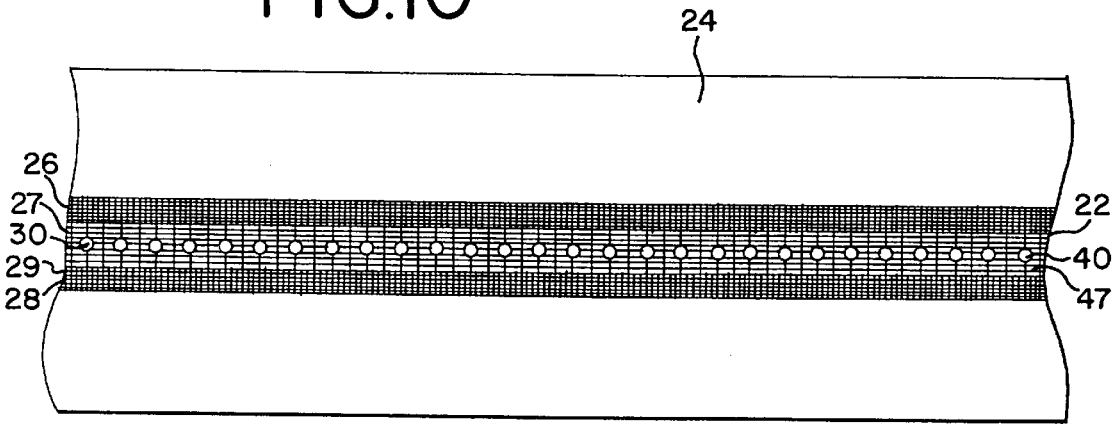
FIG. 10 is an improved manifold having three areas of different flow resistance, corresponding to FIG. 9.

FIGS. 9 and 10 illustrate an embodiment in which an area 30 of lower flow resistance, oriented parallel to the direction of container travel, is between two similarly oriented regions 27 and 29 of intermediate flow resistance. The regions 27 and 29 are also bounded by two similarly oriented regions 26 and 28 of higher flow resistance. This embodiment provides even better protection of the higher velocity stream passing through the region 30, from exposure to surrounding air. This embodiment is particularly useful for purging tall containers.

Referring to FIG. 9, the areas 26 and 28 of higher flow resistance are each formed by layering three screen segments 43, 45 and 47 on top of each other. The screen segments can be joined together and to bottom plate 41 by welding and/or other mechanical means. The regions 26 and 28 of higher flow resistance involve cooperation between portions of screen layers 43, 45 and 47, without influence from the larger openings 40 in layer 47 (FIG. 10).

The region 30 of lower flow resistance, by comparison, includes only a single layer 47 of relatively open screen, with a row of circular openings 40 therein (FIG. 10), oriented parallel to the direction of container travel. The regions 27 and 29 of intermediate flow resistance are formed by portions of the screen layers 45 and 47 acting in cooperation, without the screen layer 43, and without influence from openings 40 in the layer 47.

As exemplified in FIGS. 8, 9 and 11, many different embodiments of the chamber 18 can be employed. FIG. 8 illustrates the use of a screen diffuser 19 below the inlet 20, to help diffuse gas entering the chamber 18. FIG. 9 illustrates the use of both a screen diffuser 19 and a solid plate 21 below the inlet 20, to direct controlled environment gas to the left and right of the inlet 20 as shown by the arrows. Porous media 23 can be installed between the plate 21 and screen diffuser 19 to assist in this lateral diffusion. FIG. 11 (focusing on narrower containers and the use of smaller chamber 18 and manifold 22) does not illustrate the use of a diffusing mechanism below the inlet 20. In FIG, 11, the chamber 18 is formed from a primarily two-piece construction. The wider steel top piece 15 and slightly narrower steel bottom piece 17 are joined using gaskets 19, preferably of polyurethane foam, to prevent leakage between the two pieces.

Figure 4:
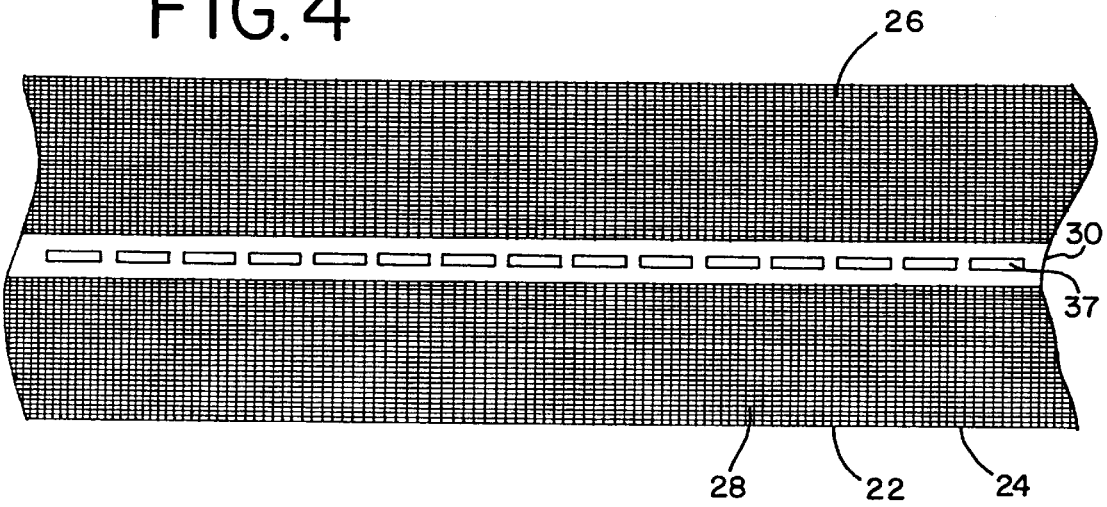
FIG. 4 is an alternative embodiment of the manifold shown in FIG. 3.
Figure 5:
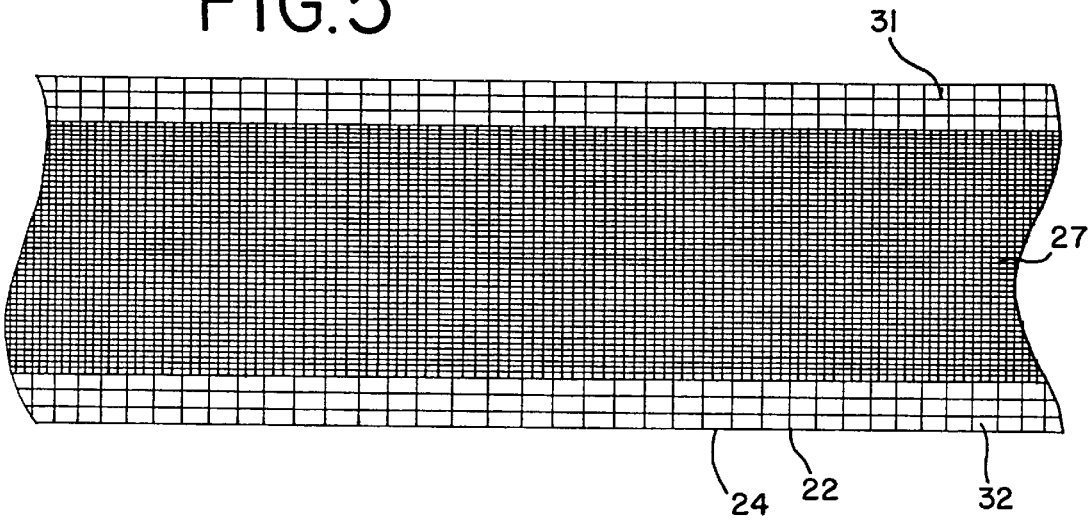
FIG. 5 is a second alternative embodiment of the manifold shown in FIG. 3.
Figure 6:
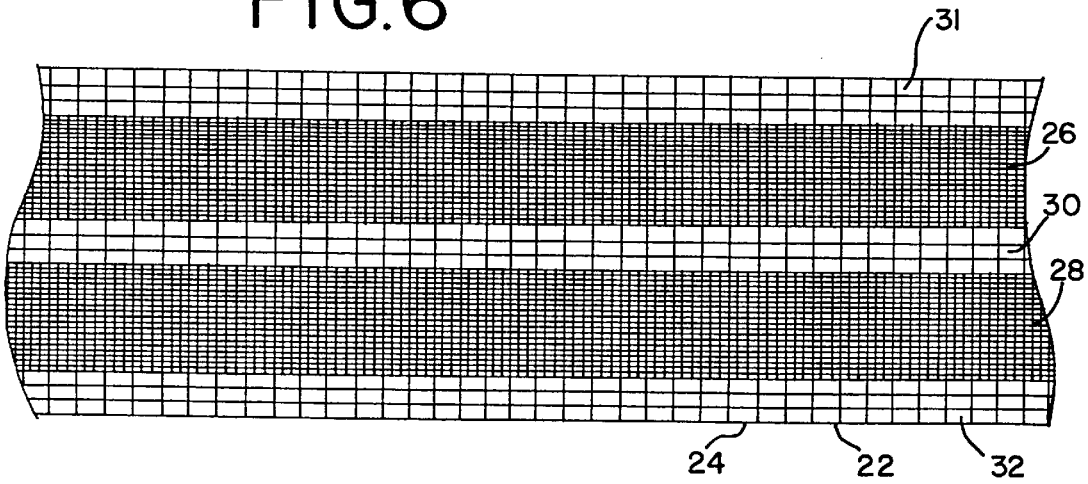
FIG. 6 is a third alternative embodiment of the manifold shown in FIG. 3.

FIGS. 4, 5 and 6 each illustrate different embodiments of a distribution manifold 22. In FIG. 4, the areas 26 and 28 of higher flow resistance are much wider than the area 30 of lower flow resistance and the manifold 22 constitutes the entire bottom 24 of the chamber 18. Also, the area 30 of lower flow resistance is formed from a perforated plate instead of a screen, with the slots 37 being oriented parallel to the direction of container travel. Compared to FIG. 3, a higher proportion of controlled environment gas from the source 20 would be used to form the controlled environment gas blanket, and a correspondingly lower proportion would be used for purging, if the manifold 22 of FIG. 4 were employed. The embodiment of FIG. 4 might be used for flushing wide, shallow containers which have less need for a deep, high velocity flush than the container 22 shown in FIG. 7.

FIG. 5 illustrates an embodiment of the manifold 22 having a large area 27 of higher flow resistance in the center and two smaller areas 31 and 32 of lower flow resistance along the sides. This embodiment can be used for special applications requiring protection from outside drafts or breezes, such as might be caused by machinery with moving parts. The controlled environment gas blanket is formed by lower velocity controlled environment gas passing through the high resistance flow region 27, and is protected from mixing with outside air by the higher velocity controlled environment gas passing through low resistance flow regions 31 and 32.

FIG. 6 illustrates an embodiment which combines the features shown in FIGS. 4 and 5. A center region 30 of lower flow resistance, used for purging, is bounded by two adjacent regions 26 and 28 of higher flow resistance, used to form a controlled environment gas blanket. The regions 26 and 28 are also bounded by two adjacent outside regions 31 and 32 of lower flow resistance, which protect the controlled environment gas blanket from exposure to outside air.

All of the foregoing embodiments of the distribution manifold 22 have in common the features of a higher resistance (lower velocity) distribution region and an adjacent lower resistance (higher velocity) flow region disposed longitudinally above the open-top containers 22, each parallel to the direction 16 of container movement, each extending substantially the length of manifold 22, which create and maintain uniform gas flow patterns within the containers 22 passing beneath the chamber 18. All of the foregoing embodiments further have in common the use of a single, integrated distribution manifold 22, in at least one single distribution chamber 18, and a single source of controlled environment gas, to create and maintain dual velocity controlled environment gas flow. It is also possible to use multiple distribution chambers 18 in series, and/or multiple controlled environment gas sources, to improve gas distribution within each chamber 18 and to make fabrication easier.

In a preferred embodiment, a single resistance distribution region is provided that allows for a single velocity flow which may be used, for example, in applications with slower line speeds. A single velocity flow system provides a design that simplifies screen replacement and maintenance. Moreover, in some applications, the single velocity flow region may achieve adequate residual oxygen levels. In fact, with manifold widths and screen opening sizes optimized for a specific empty or filled container, oxygen residuals of less than 0.5 percent may be consistently achieved with a single velocity flow region. Oxygen residuals have been measured in PPM (parts per million) for both empty and filled containers in both open gassing systems (without sidewalls) and closed gassing systems (with sidewalls), and with both single, and dual velocity flow manifolds.

A preferred controlled environment gas flushing system for removing oxygen from containers is directly dependent on a series of variables including, for example, the flow rate of the controlled environment gas, the shape of the container and size of the opening, the width of the flow region or manifold, the type of diffuser, the mesh size, the speed of the conveyer, and the distance between the manifold and the container. The preferred manifold width, for example, may be determined by holding the remaining variables constant. This width may differ for an empty container purge and a headspace purge.

Figure 12:
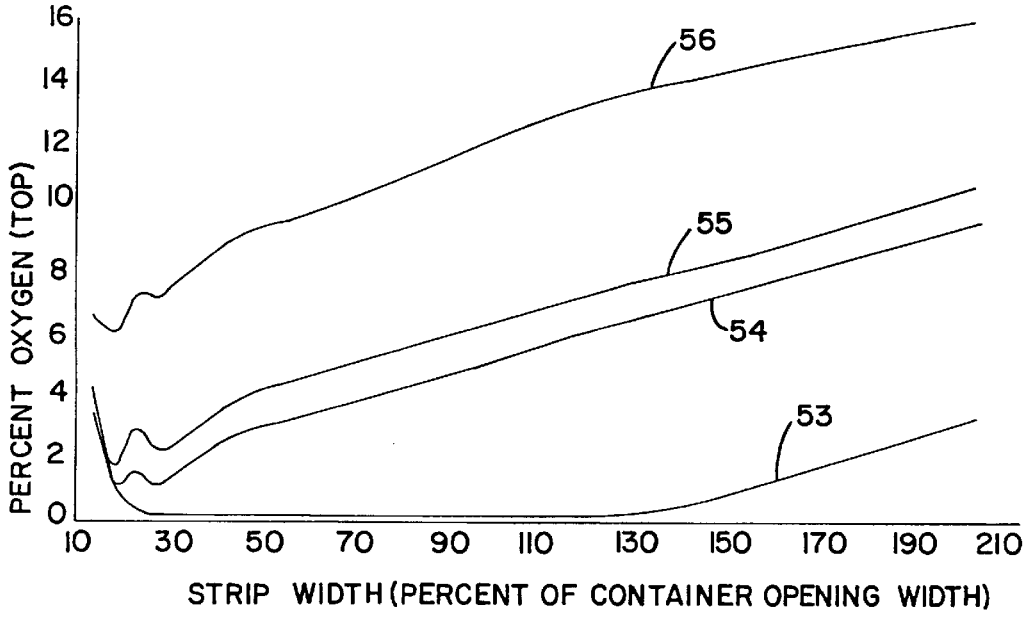
FIG. 12 is a graph showing, at varying simulated conveyer speeds, the percent of residual oxygen (generated from sensor readings taken at ½ inch from the top of the container) in a purged empty 211×408 can based on varying manifold or strip widths which are indicated as a percentage of the container opening diameter.
Figure 13:
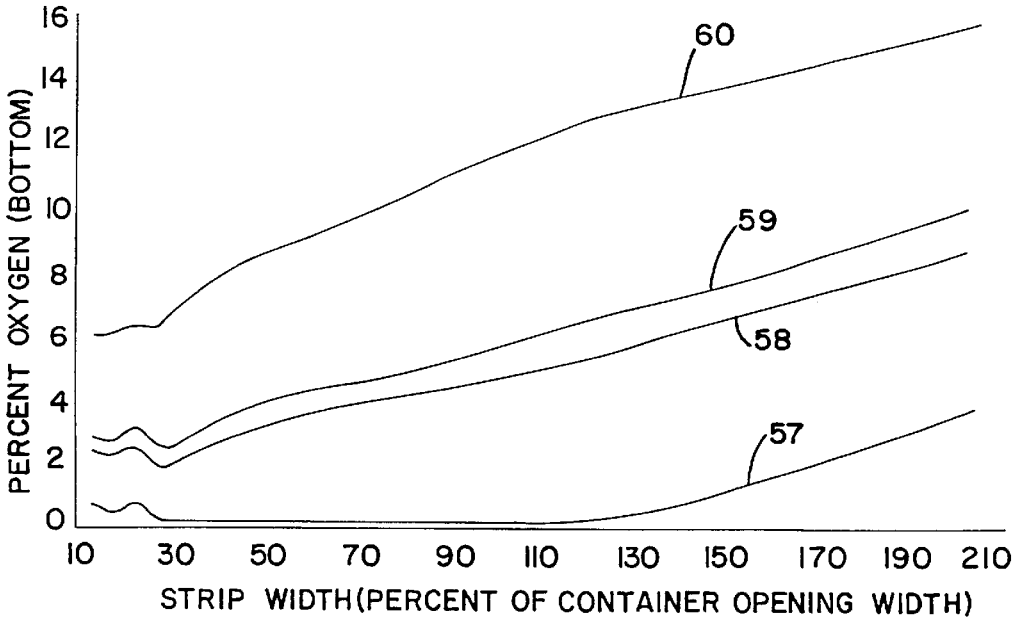
FIG. 13 is a graph showing, at varying simulated conveyer speeds, the percent of residual oxygen (generated from sensor readings taken at ½ inch from the bottom of the container) in a purged empty 211×408 can based on varying manifold or strip widths which are indicated as a percentage of the container opening diameter.

To determine a preferred manifold width, a series of tests may be conducted in a wind tunnel which can approximate the wind speeds generated by the movement of containers along a conveyer. FIGS. 12 and 13, for example, are graphs of the percent oxygen remaining in an empty 211×408 can as the result of manifold widths or strip widths ranging between 0.375 through 5.5 inches. To generate the data for plotting the curves shown in these graphs, a series of tests were run in a wind tunnel at simulated line speeds of wind speeds of 40, 170, 200 and 520 ft./min. Within the wind tunnel, an empty 211×408 can was positioned approximately 0.225 inch below a 29.5×6 inch chamber having a 3-ply 50 micron screen covering the manifold and providing a steady flow rate of approximately 500 scfh of nitrogen.

Figure 21:
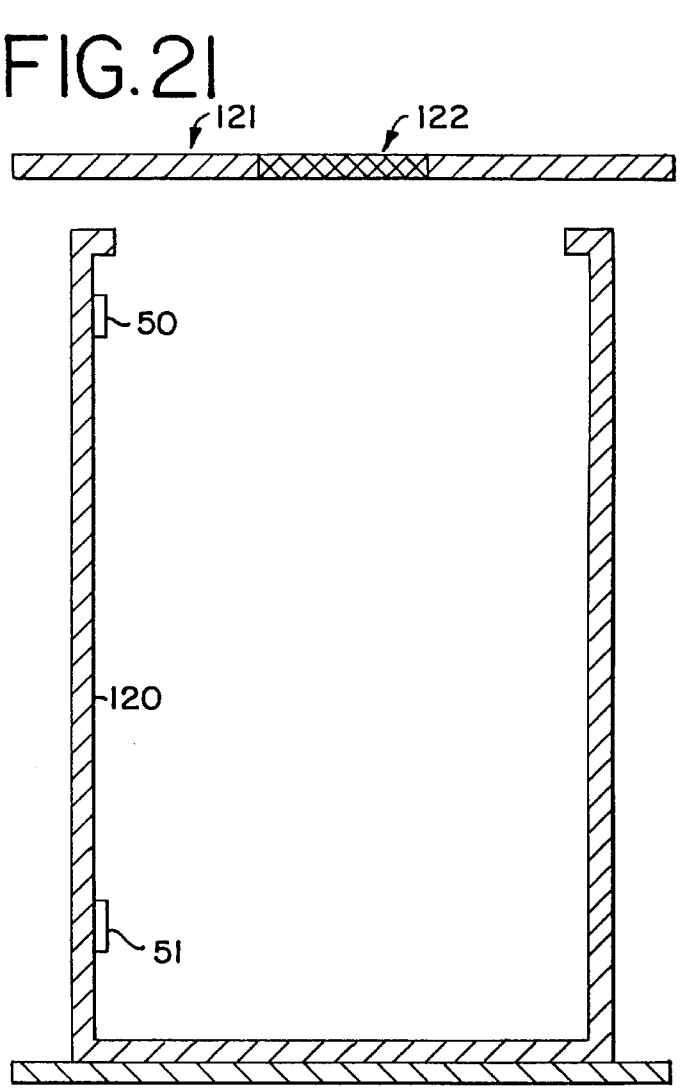
FIG. 21 is a front sectional view of a container positioned beneath a manifold for wind tunnel testing, with sensor positions indicated near the top and bottom of the inner side wall of the container.

FIG. 21 shows a generic empty container 120 within the wind tunnel, positioned beneath a chamber or rail 121 having a single velocity flow manifold 122. To measure the residual oxygen, two oxygen sensors were positioned as shown, for example, in FIG. 21, inside the empty container 120 along a side region, with one sensor so positioned ½ inch from the top of the can, and the other sensor 51 positioned ½ inch from the bottom of the can.

The curves shown in FIGS. 12 and 13 are plotted from an average of percent oxygen readings taken from wind tunnel tests conducted at various manifold widths, which are represented as a percent of the width of the container opening. The width of the standard 211×408 cans used have a width or diameter of approximately 2.688 inches. The percent oxygen readings are an average of a series of test readings taken from the top sensor and bottom sensor at each of the selected manifold widths. The data plotted for curves 53 and 57 was taken at relatively low conveyer or wind speeds of approximately 40 ft./min. The data plotted for curves 54 and 58 was taken at a wind speed of approximately 170 ft./min. The data plotted for curves 55 and 59 was taken at wind speeds of approximately 200 ft./min. And, the data plotted for curves 56 and 60 was taken at relatively high wind speeds of 520 ft./min.

It can be recognized that at each of the wind speeds, there is a rapid drop in the percentage oxygen remaining in the container when the manifold width is less than approximately 50 percent of the container diameter. It can also be seen at each of the wind speeds that at manifold widths approximately equal to or 100 percent of the can opening diameter the percentage of oxygen levels increase. This increase is dramatic at the low wind speeds of 40 ft./min. as shown by curves 53 and 57, which may in part be caused by the flow of controlled environment gas extending over the width of the manifold, which in effect, compresses and prevents the outward flow of air from the container.

It can also be seen that the percentage oxygen increases if the manifold width is below about 25 percent of the width of the container. This may, in part, be the result of turbulence caused by the increased velocity of the controlled environment gas entering the container. A preferred manifold width, for example, for removing oxygen from a 211×408 container at the above listed test conditions, would be between approximately about ¼ and ⅓ of the container opening width.

Figure 14:
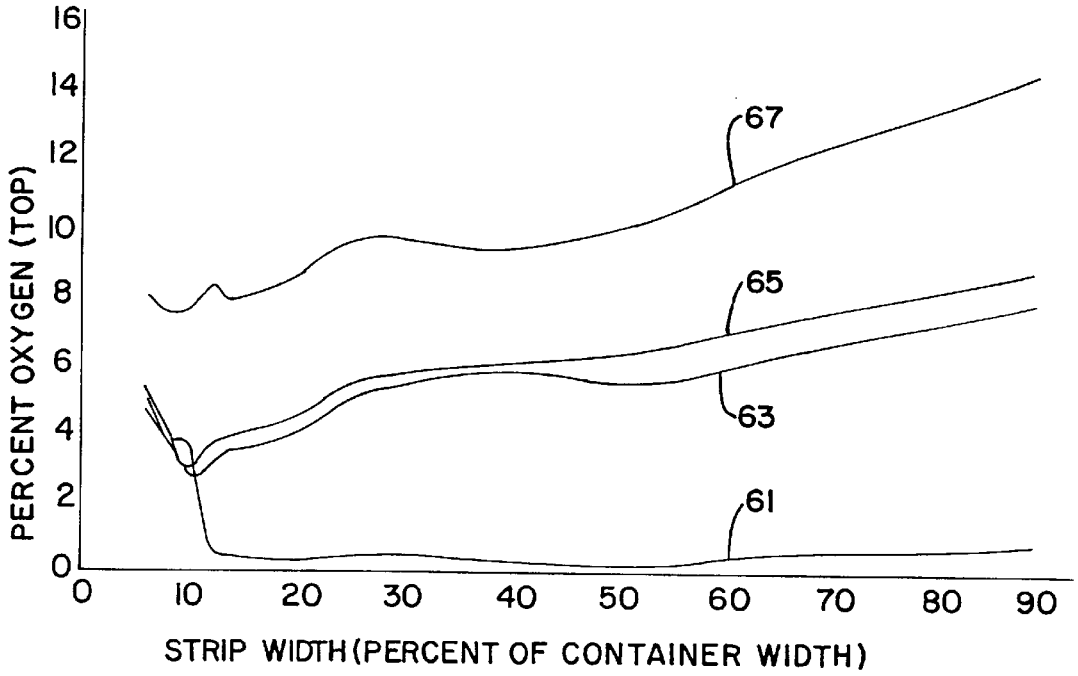
FIG. 14 is a graph showing, at varying simulated conveyer speeds, the percent of residual oxygen (generated from sensor readings taken at ½ inch from the top of the container) in a purged empty 603×700 can based on varying manifold or strip widths which are indicated as a percentage of the container opening diameter.
Figure 15:
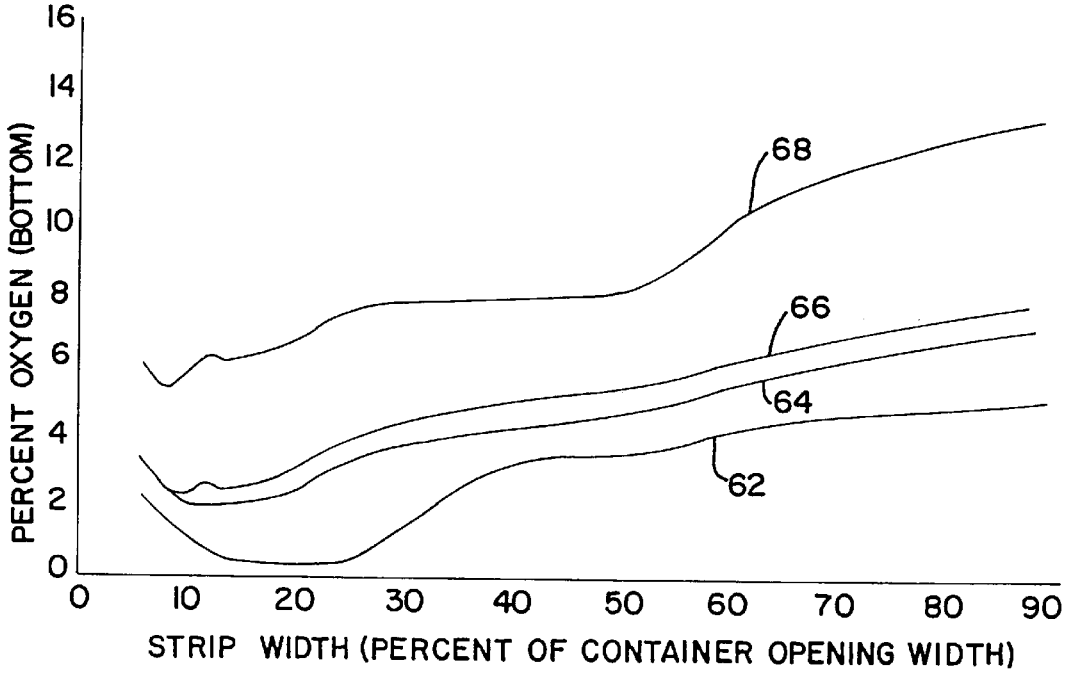
FIG. 15 is a graph showing, at varying simulated conveyer speeds, the percent of residual oxygen (generated from sensor readings taken at ½ inch from the bottom of the container) in a purged empty 603×700 can based on varying manifold or strip widths which are indicated as a percentage of the container opening diameter.

FIGS. 14 and 15 show graphs of wind tunnel test results on a larger 603×700 can using the same test conditions and rail configuration as described above for the 211×408 can.

FIG. 14 shows oxygen percentages computed from data collected from a top sensor 50 (shown in FIG. 21). FIG. 15 shows oxygen percentages computed from data collected from a bottom sensor 51 (shown in FIG. 21).

The data plotted for curves 61 and 62 was taken at relatively low conveyer or wind speeds of approximately 40 ft./min. The data plotted for curves 63 and 64 was taken at a wind speed of approximately 170 ft./min. The data plotted for curves 65 and 66 was taken at wind speeds of approximately 200 ft./min. And, the data plotted for curves 67 and 68 was taken at relatively high wind speeds of 520 ft./min.

It can be recognized that at each of the wind speeds, there is a rapid drop in the percentage oxygen remaining in the container when the manifold width is less than approximately 25 percent of the container diameter. It can also be seen at each of the wind speeds that at manifold widths approximately 15 percent of the can opening diameter the percentage of oxygen levels increase. This increase is dramatic at the low wind speeds of 40 ft./min. as shown by curves 61 and 62, which may in part be caused by increased turbulence caused by the increased velocity of flow. A preferred manifold width, for example, for removing oxygen from a standard 603×700 container at the above listed test conditions, would be between about 15 and 20 percent of the container opening width.

Figure 16:
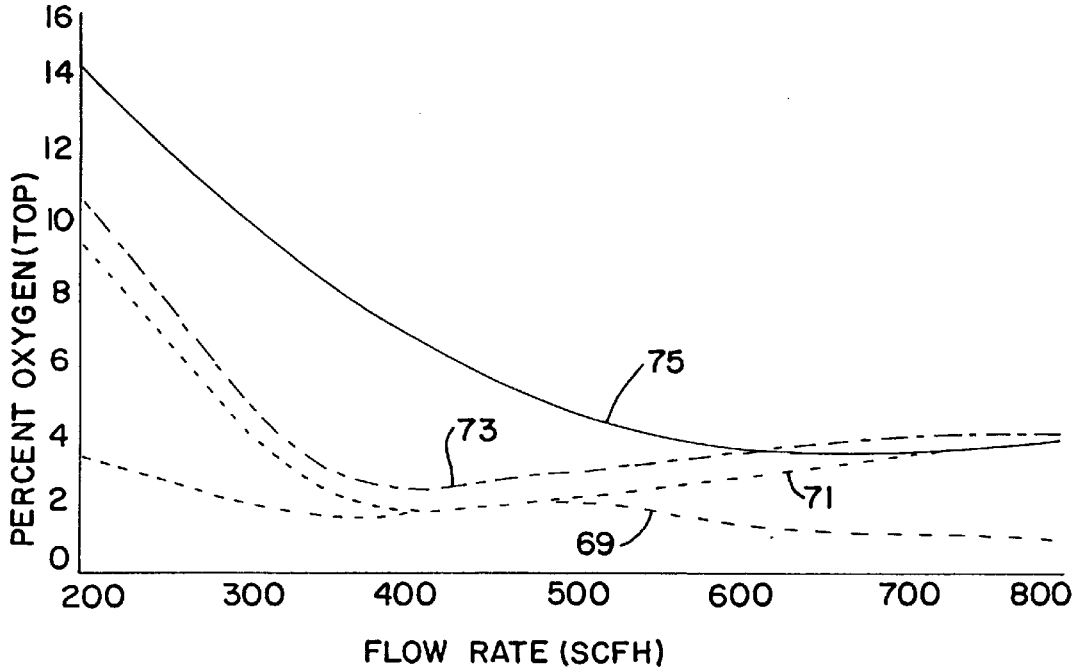
FIG. 16 is a graph showing, at varying simulated conveyer speeds, the percent of residual oxygen (generated from sensor readings taken at ½ inch from the top of the container) in a purged empty 401×502 can based on varying controlled environment flow rates.
Figure 17:
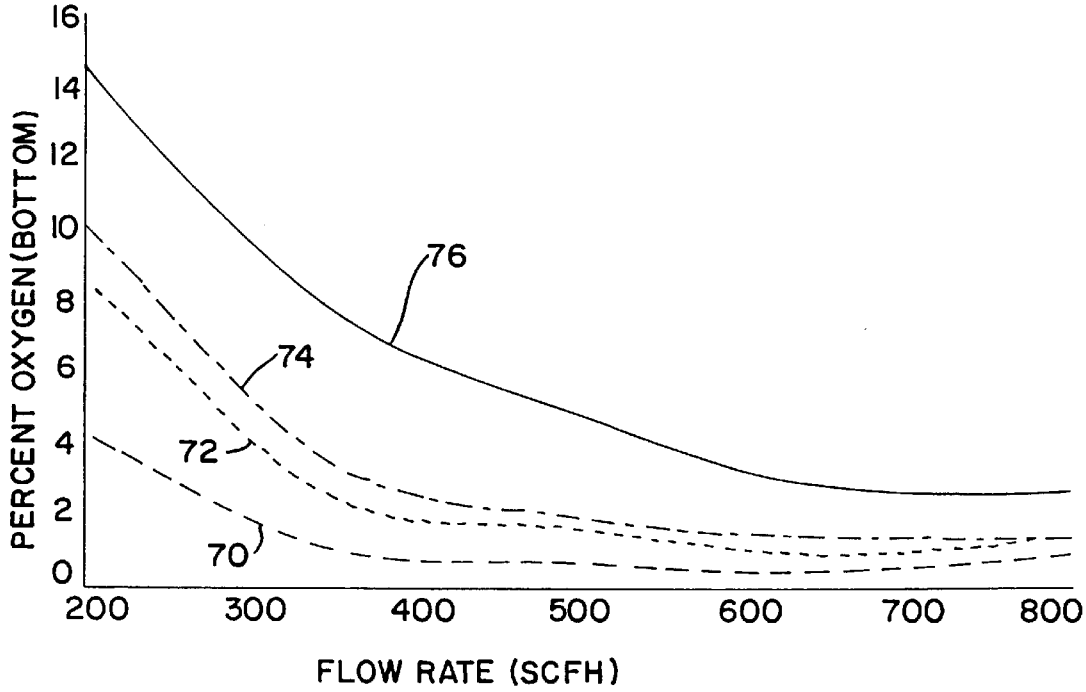
FIG. 17 is a graph showing, at varying simulated conveyer speeds, the percent of residual oxygen (generated from sensor readings taken at ½ inch from the bottom of the container) in a purged empty 401×502 can based on varying controlled environment flow rates.

Wind tunnel tests were also run to determine preferable flow rates at varying conveyer speeds. FIGS. 16 and 17 show graphs of wind tunnel test results on a 401×502 can using the same test conditions and rail configuration as described above, except that these tests held constant the manifold width at 0.625 inch, to determine the residual oxygen percentages at flow rates ranging between 200 and 800 scfh. The manifold tested had a 0.3125 inch wide low resistance flow region of 80 micron 2-ply mesh between parallel 0.15625 inch wide high resistance flow regions of 40 micron 5-ply mesh. The oxygen residual percentages for FIGS. 16 and 17 were calculated from data recorded from the top sensor 50 and bottom sensor 51, respectively.

The data plotted for curves 69 and 70 was taken at relatively low conveyer or wind speeds of approximately 40 ft./min. The data plotted for curves 71 and 72 was taken at a wind speeds of approximately 170 ft./min. The data plotted for curves 73 and 74 was taken at wind speeds of approximately 200 ft./min. And, the data plotted for curves 75 and 76 was taken at relatively high wind speeds of 520 ft./min.

If, for example, an oxygen residual of approximately 2 percent or less was desired, a flow rate of as low as 300 scfh, for the above test conditions, could be used at a conveyer speed of 40 ft./min. At higher conveyer speeds of approximately 200 ft./min., a flow of approximately 500 scfh would be required to achieve an oxygen residual of approximately 2 percent. Taking into account the differing flows and conveyer speeds, the volume of controlled environment gas used per foot traveled along the conveyer would be approximately one third less using the higher flow of 500 scfh with higher conveyer speed of 200 ft./min. than using the lower flow of 300 scfh with lower conveyer speed of 40 ft./min.

Figure 22:
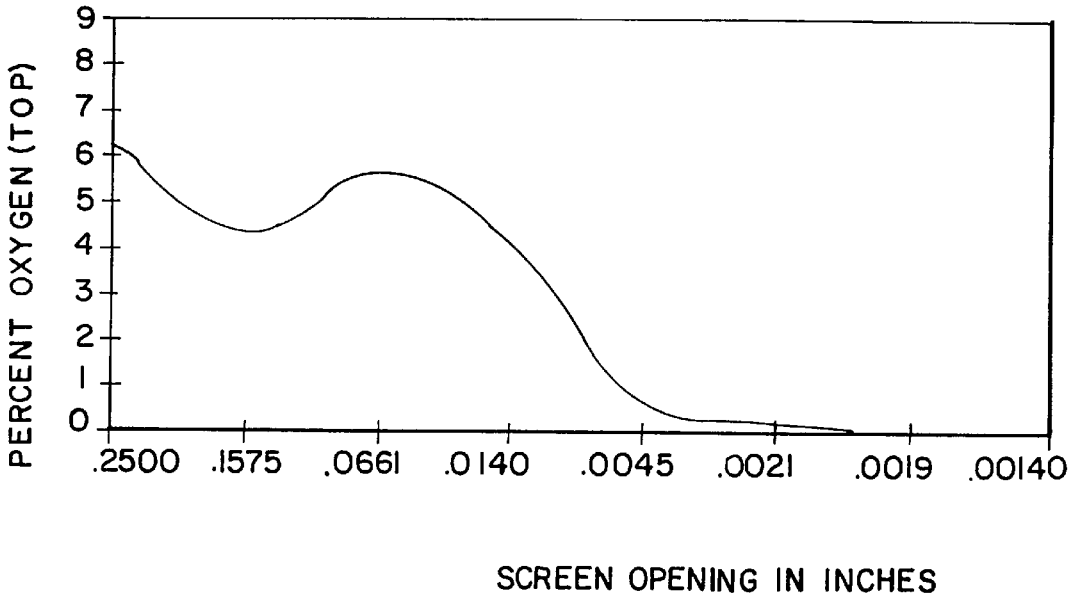
FIG. 22 is a graph showing the percentage of residual oxygen (generated from sensor readings taken at ½ inch from the top of the container) in a purged empty 401×502 can as a result of varying the screen openings between 0.25–0.0014 inch and applying a constant flow of controlled environment of 500 scfh through the 0.625 inch wide screened manifold with a length of 29.5 inches at a constant simulated conveyer speed of 40 ft./min.
Figure 23:
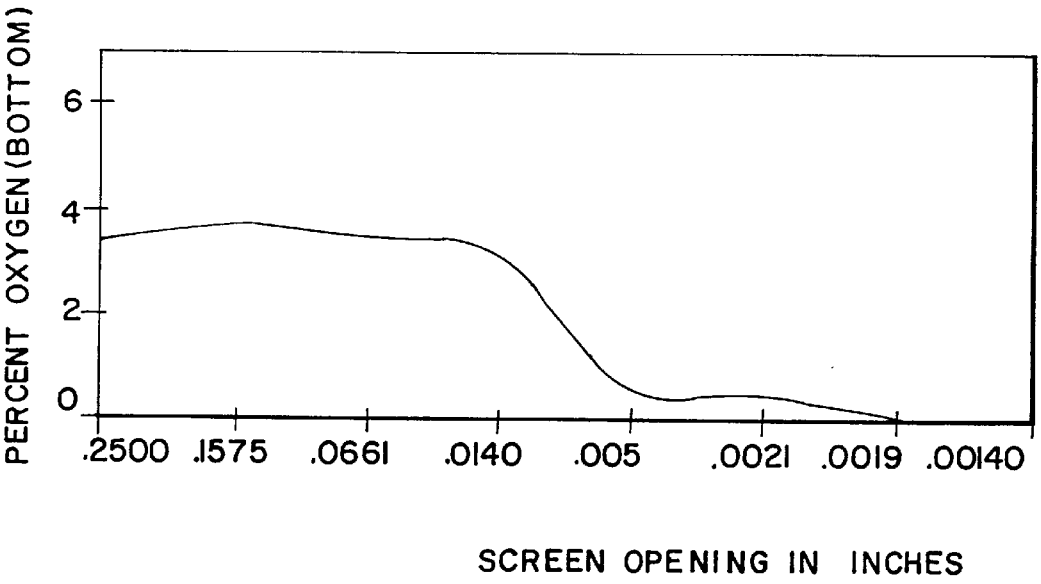
FIG. 23 is a graph showing the percentage of residual oxygen (generated from sensor readings taken at ½ inch from the bottom of the container) in a purged empty 401×502 can as a result of varying the screen openings between 0.25–0.0014 inch and applying a constant flow of controlled environment of 500 scfh through the 0.625 inch wide screened manifold with a length of 29.5 inches at a constant simulated conveyer speed of 40 ft./min.

Wind tunnel tests were also run to determine preferable screen opening sizes at varying conveyer speeds, for the referenced test conditions. FIGS. 22 and 23 show graphs of wind tunnel test results on a 401×502 can using the same test conditions and rail configuration as described above, except that these tests held constant the manifold width at 0.625 inch and flow rate at 500 scfh, to determine the residual oxygen percentages at varying screen openings ranging between 0.25 and 0.00140 inch. The oxygen residual percentages for FIGS. 22 and 23 are calculated from data recorded from the top sensor 50 and bottom sensor 51, respectively.

Figure 24:
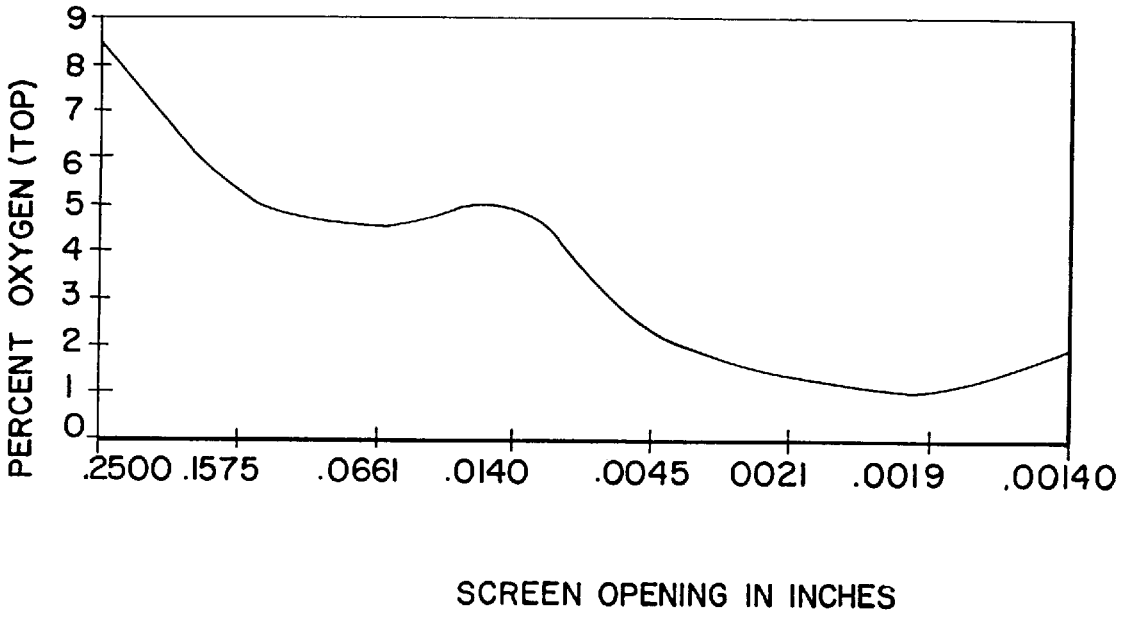
FIG. 24 is a graph showing the percentage of residual oxygen (generated from sensor readings taken at ½ inch from the top of the container) in a purged empty 401×502 can as a result of varying the screen openings between 0.25–0.0014 inch and applying a constant flow of controlled environment of 500 scfh through the 0.625 inch wide manifold with a length of 29.5 inches at a constant simulated conveyer speed of 170 ft./min.
Figure 25:
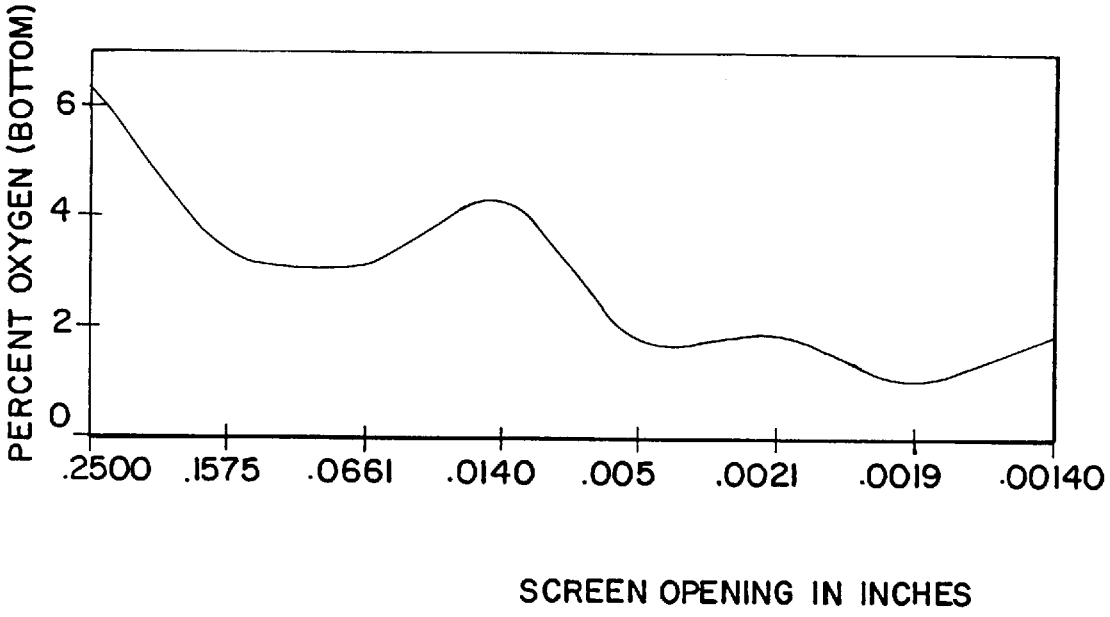
FIG. 25 is a graph showing the percentage of residual oxygen (generated from sensor readings taken at ½ inch from the bottom of the container) in a purged empty 401×502 can as a result of varying the screen openings between 0.25–0.0014 inch and applying a constant flow of controlled environment of 500 scfh through the 0.625 inch wide screened manifold with a length of 29.5 inches at a constant simulated conveyer speed of 170 ft./min.
Figure 26:
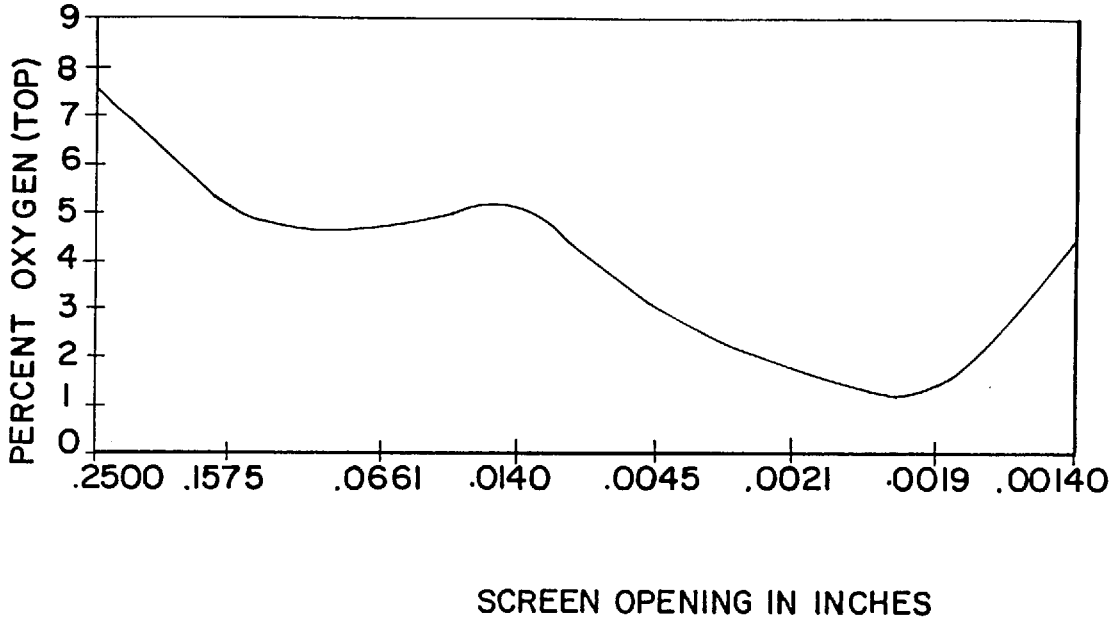
FIG. 26 is a graph showing the percentage of residual oxygen (generated from sensor readings taken at ½ inch from the top of the container) in a purged empty 401×502 can as a result of varying the screen openings between 0.25–0.0014 inch and applying a constant flow of controlled environment of 500 scfh through the 0.625 inch wide screened manifold with a length of 29.5 inches at a constant simulated conveyer speed of 200 ft./min.
Figure 27:
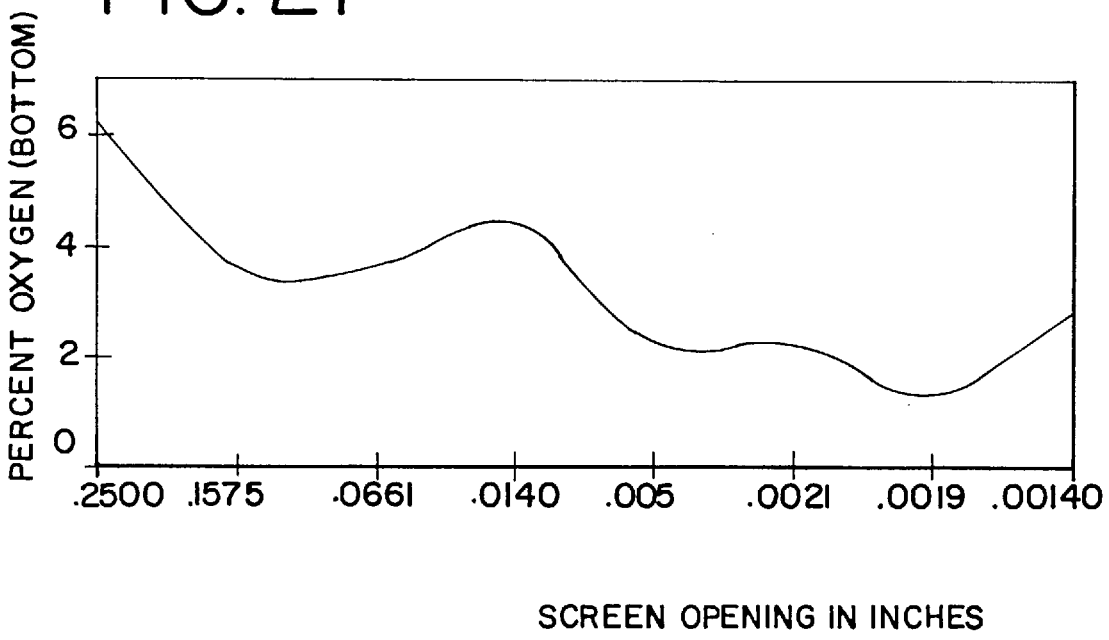
FIG. 27 is a graph showing the percentage of residual oxygen (generated from sensor readings taken at ½ inch from the bottom of the container) in a purged empty 401×502 can as a result of varying the screen openings between 0.25–0.0014 inch and applying a constant flow of controlled environment of 500 scfh through the 0.625 inch wide screened manifold with a length of 29.5 inches at a constant simulated conveyer speed of 200 ft./min.
Figure 28:
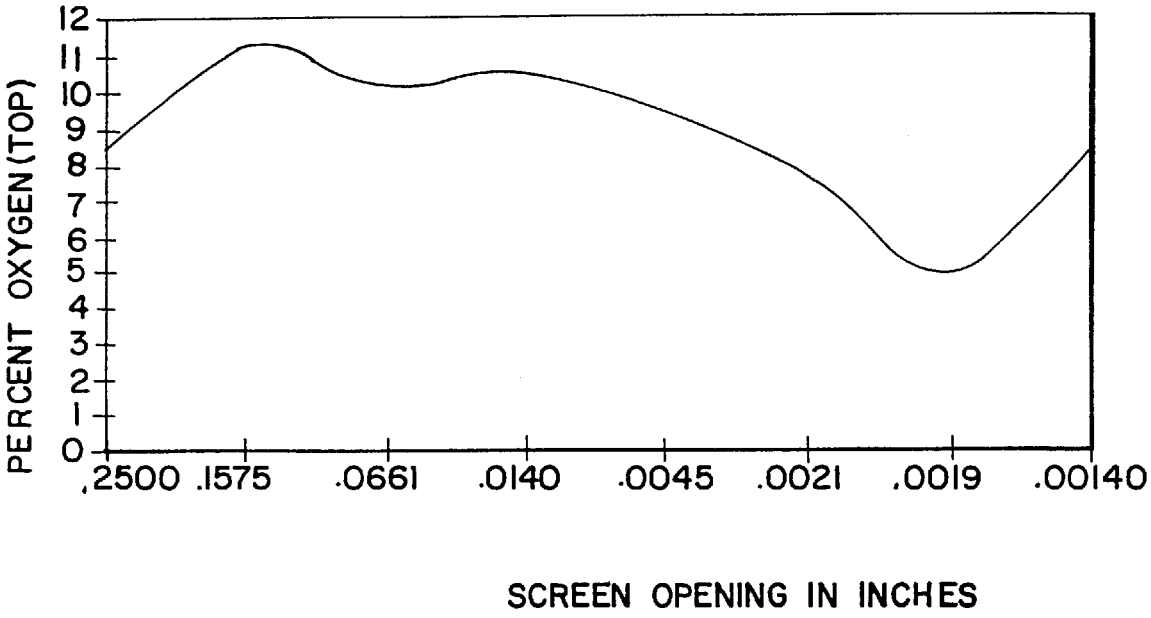
FIG. 28 is a graph showing the percentage of residual oxygen (generated from sensor readings taken at ½ inch from the top of the container) in a purged empty 401×502 can as a result of varying the screen openings between 0.25–0.0014 inch and applying a constant flow of controlled environment of 500 scfh through the 0.625 inch wide screened manifold with a length of 29.5 inches at a constant simulated conveyer speed of 520 ft./min.
Figure 29:
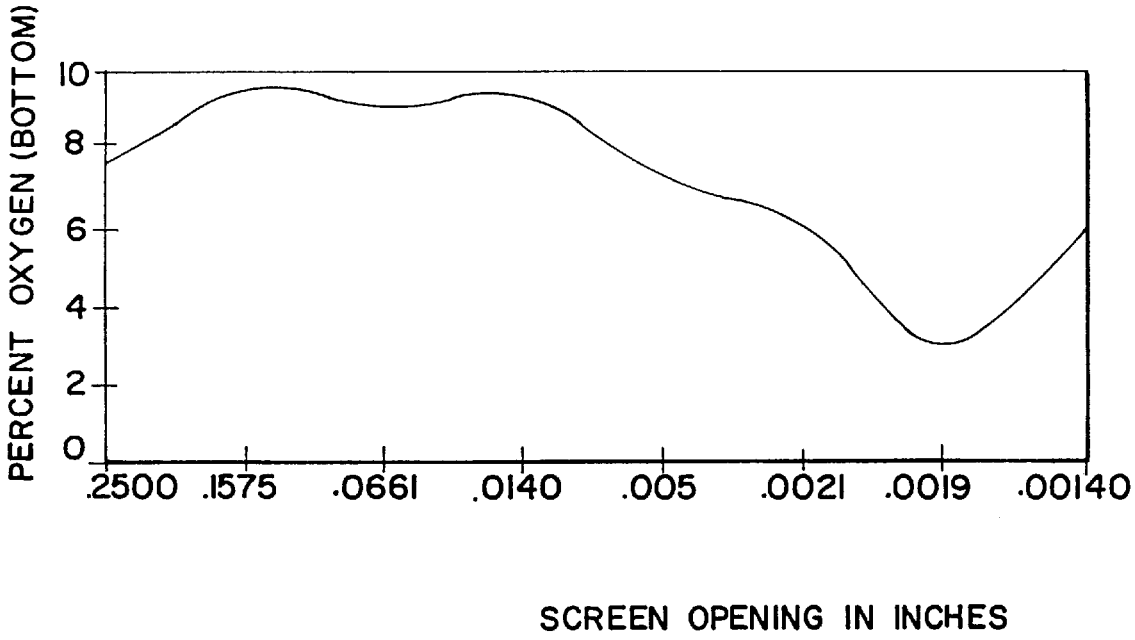
FIG. 29 is a graph showing the percentage of residual oxygen (generated from sensor readings taken at ½ inch from the bottom of the container) in a purged empty 401×502 can as a result of varying the screen openings between 0.25–0.0014 inch and applying a constant flow of controlled environment of 500 scfh through the 0.625 inch wide screened manifold with a length of 29.5 inches at a constant simulated conveyer speed of 520 ft./min.

The data used for curves 100 and 101 was taken at relatively low conveyer or wind speeds of approximately 40 ft./min. The data plotted for curves 102 and 103 was taken at wind speeds of approximately 170 ft./min. (See FIGS. 24 and 25). The data plotted for curves 104 and 105 was taken at wind speeds of approximately 200 ft./min. (See FIGS. 26 and 27). And, the data plotted for curves 106 and 107 was taken at relatively high wind speeds of 520 ft./min. (See FIGS. 28 and 29).

It can be seen in each of the curves 100–107 that the percentage oxygen levels begin to rapidly decrease at least when the diameters of the screen openings are at 0.0140 inch. At the extremes of the tested wind speeds, 520 and 40 ft./min., the oxygen residuals level off at opening sizes greater than 0.014 inch. At the wind speeds of 170, 200, and 520 ft./min., the oxygen residual again increases at opening sizes smaller than 0.0019 inch. This rise may in part be due to the increased velocity through the smaller openings causing a more turbulent flow. For these test conditions, a preferred screen opening size of 0.0019 would be selected to achieve substantially laminarized flow.

Figure 18:
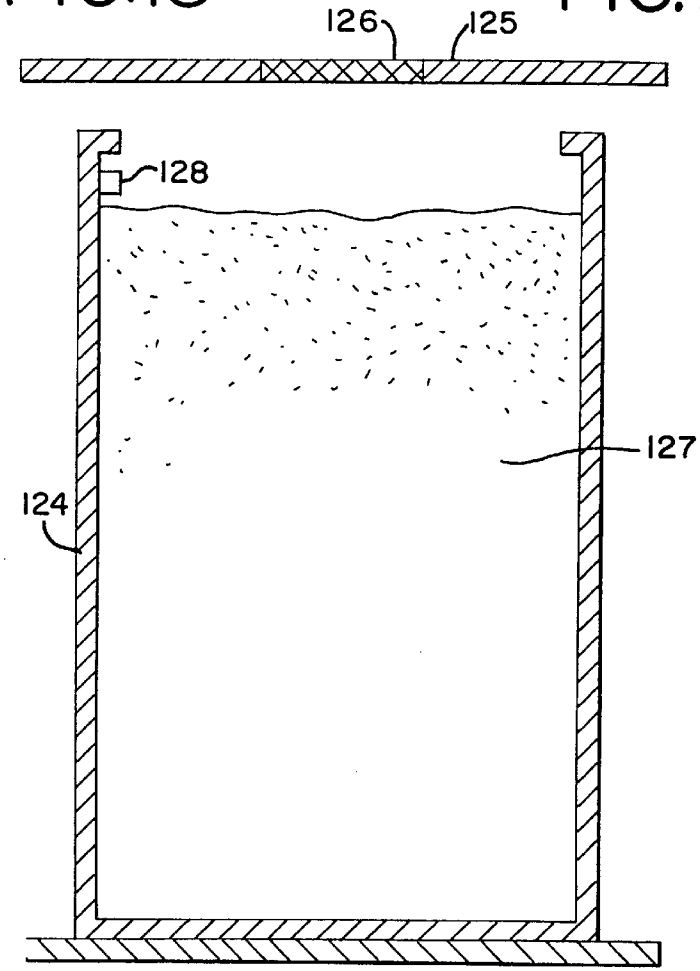
FIG. 18 is a front sectional view of a filled container positioned beneath a manifold for wind tunnel testing, with the sensor positioned above the product on an inner side wall of the container.

Wind tunnel tests were also conducted on containers filled with product to simulate a headspace purging process. FIG. 18 shows a generic container 124 which is filled with product 127 and positioned in a wind tunnel below the rail 125 having manifold 126. For the headspace-purge testing, the oxygen sensor 128 was positioned on the inner side wall, above the product 127.

Wind tunnel tests have shown that residual oxygen levels consistently less than 1 percent can be achieved. For example, a test was conducted using the same chamber and manifold arrangement as described above for a 401×502 can filled with infant formula. The headspace was purged at a flow rate of 500 scfh through a manifold positioned approximately 0.225 inch above the can top and having a width of 0.625 inch and a length of 29.5 inches. The manifold had a 0.250 inch wide low resistance flow region of 80 micron 2-ply mesh between parallel two 0.375 inch wide high resistance flow regions of 40 micron 5-ply mesh. At wind speeds of 40, 170 and 200 ft./min. residual oxygen readings were consistently below 1 percent. Further testing has shown that for maintaining pre-purged oxygen levels in a filled container it is advantageous to position the manifold as close to the can top as possible without disrupting the movement of cans along the conveyer.

Figure 19:
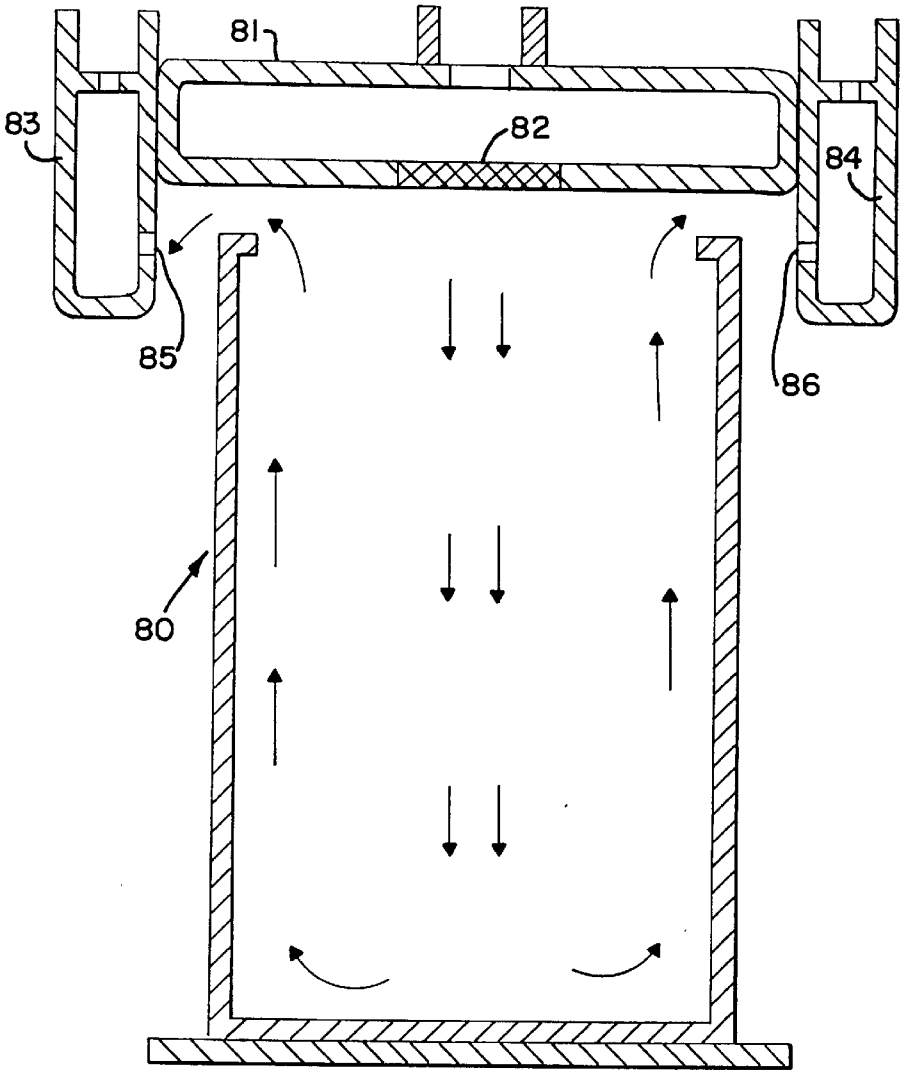
FIG. 19 is a front sectional view of a single empty container being purged with an alternative manifold embodiment having return gas side chambers extending below the container opening.

Referring to FIG. 19, a container 80 is shown positioned below a chamber 81 having a manifold 82 distributing controlled environment gas into the container. Extending below the opening of the container on either side of the chamber 81 are side return gas chambers 83 and 84, which have a length coextensive with the length of the chamber 81. These return gas chambers are at reduced pressure to capture the controlled environment gas through inlets 85 and 86 as it exits the container, as shown by the arrowed controlled environment gas flow lines.

Figure 20:
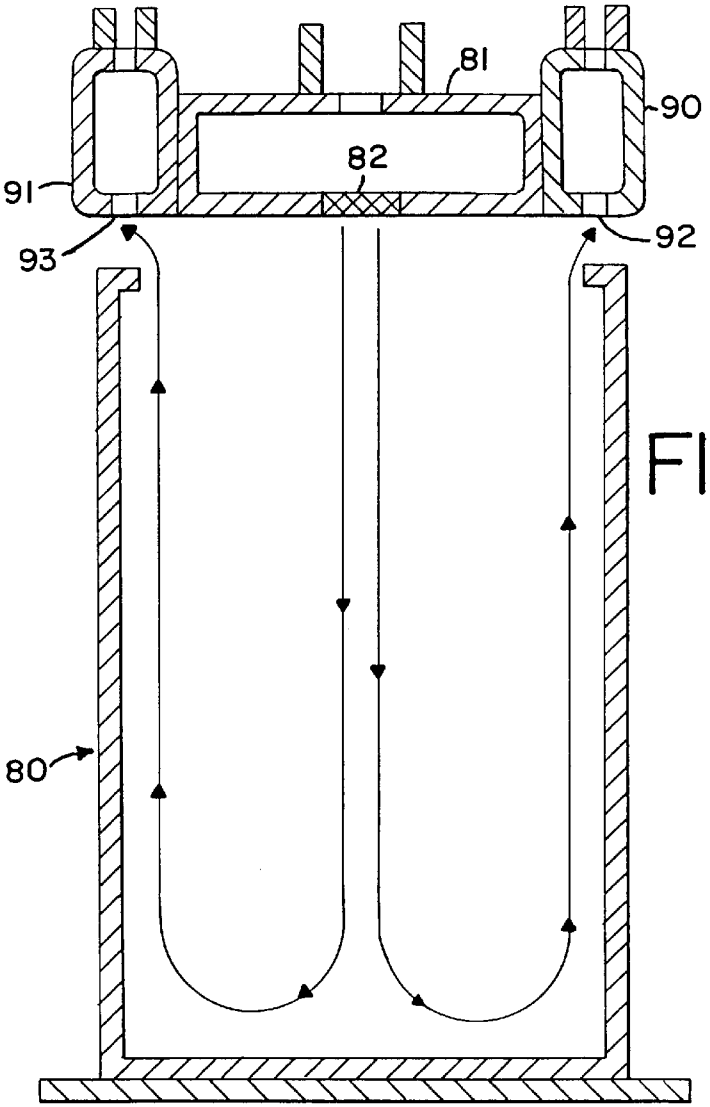
FIG. 20 is a front sectional view of a single empty container being purged with an alternative manifold and return gas side chambers.

In an alternative embodiment, as shown in FIG. 20, the return air side chambers 90 and 91 can be positioned next to the chamber 81. The inlet openings 92 and 93 are positioned slightly outside the outside diameter of the container opening to allow for an optimal controlled environment gas flow pattern within the container (as shown by the arrowed flow lines), and without disturbing the substantially laminar flow of the purging gas distributed through the manifold 82.

An alternative preferred embodiment of a return gas and gassing rail system is shown in FIG. 30. The rail 200 has a bottom portion 202, a center portion 204, and a top portion 206. Preferably the rail 200 has a one foot section length that can be connected end to end in series to provide the desired length of rail.

Each section of rail 200 includes a controlled environment gas inlet pathway 210 and a return gas pathway 212. The pathways 210, 212 are formed through the top, center and bottom rail portions 202, 204, 206, and all three portions are clamped together with clamping assemblies 214 which are positioned at each end of the one foot sections of rail 200. The return gas pathway 212 preferably provides tube-like passages formed at one longitudinal end of the rail section which communicate with expanded channels 218 which run along the longitudinal sides of the rail 200 to collect gas exiting from the container 225.

A vacuum source (not shown) is applied to the return gas pathway 212 to pull the gas exiting the container into the channels 218 and through to a reservoir (not shown), as indicated by arrows 221. A screen 222 or other porous material is preferably positioned within a recess formed in the lower rail portion 202 and in communication with the channel passages 218 to distribute the vacuum over the entire length of the screen 222. The collected gas may potentially be reused in the gassing system, for example, in entry or beginning sections of the rail where a high purity level of controlled environment is not necessary.

For example, for processing requiring the reduction of oxygen levels, as long as the reused gas contains a lower oxygen residual than the air within the container, it will aid in the removal of oxygen from the container. Controlled environment gas is provided from a source (not shown) into the controlled environment pathway 210 as indicated by arrow 211. The controlled environment gas passes through a tube-like inlet passage 215 formed in the top portion of the pathway 210, and located at a longitudinal end of the section of rail. Preferably the inlet passage 215 is located at the same end as the return gas outlet 213. The controlled environment gas passes through a top screen or baffle 234 filters the controlled environment gas and helps quiet any noise created by the passage of controlled environment gas through the pathway 210.

The inlet passage 215 extends partially into the center portion of the pathway 210 and then enters into an expanded channel 226 which extends longitudinally along the rail 200. Positioned within the channel 226 is a distribution screen 232 which evens the flow which is concentrated at one end of the channel 226. The controlled environment gas passes into a wider channel 236 and through a top screen or resistance element 228.

The top screen has an opening along its center for allowing the controlled environment gas to pass directly through a lower screen or resistance element 230. O-rings 216 are positioned to prevent leakage of the controlled environment gas and return gasses. Sidewalls 240 may preferably be positioned adjacent, and preferably contiguous to the longitudinal sides of the rail 200 to reduce the amount of outside air which is pulled into the return gas reservoir. Bottom walls 242 extending from the longitudinal sides of the conveyer 244 and connecting to the sidewalls 240, may be used to further shut out the outside environment and may provide a more efficient gassing operation. The embodiments shown in FIGS. 19–21, and 30 may alternatively be used for headspace purging operations.

Preferably, the width of the rail or width of the entire chamber with return chambers are at least about 75 percent of the width of the container opening, and more preferably at least about as wide as the container opening. Alternatively, other coverings or structure, including horizontal top walls extending along the length of the chamber or rail, may be used to substantially cover the container opening to provide a more efficient gassing system. Alternatively, the chamber or rail may be of various shapes and sizes, and may be narrower than the preferred chamber or rail width. For example, a chamber having approximately the same width and length of the manifold may be used in conjunction with top walls positioned adjacent to and extending horizontally from the longitudinal sides of the manifold and/or chamber, so as to substantially cover the container opening.

The above wind tunnel tests were conducted by positioning the manifold 0.225 inch above the container and allowing a period of time to reach steady state before samples were taken. It should be noted that given sufficient purging time, oxygen residuals can be significantly lowered by decreasing the distance between the manifold and the can. In addition, controlled environment gas usage can be significantly reduced by maintaining these reduced distances.

For example, wind tunnel tests were conducted to determine a preferred positioning distance of the manifold above the top of the containers traveling along the conveyer. Wind tunnel test results on a 401×502 can using the same test conditions as described above except that the manifold width was held constant at 0.625 inch, the flow rate was held constant at approximately 500 scfh and the simulated conveyer speed was held constant at approximately 200 ft./min. to determine the residual oxygen percentages resulting from varying the distance of the manifold above the can top between 0.5 inch and 0.001 inch. The manifold tested had a 0.3125 inch wide low resistance flow region of 80 micron 2-ply mesh between parallel 0.15625 inch wide high resistance flow regions of 40 micron 5-ply mesh.

The oxygen readings taken from both the top and bottom sensors indicate that it is desirable to position the manifold as close as possible to the top of the can without interfering with the movement of the can along the conveyer. In designing the system the container height tolerances should be accounted for in positioning the manifold above the container. In addition, the weight of the container and its contents should be accounted for in positioning the manifold above the container, in that, heavier containers may sit lower on the conveyor. Also some containers have flanges which may interlock with other container flanges when moving along the conveyer. This interlocking most often occurs with empty and/or light product containers, for example cheese puffs, and should be accounted for in setting the vertical distance between the manifold and container tops.

Additional testing has generally shown that even narrower manifold widths may be selected when using manifold having at least two longitudinally oriented resistance regions. For example, manifold widths one tenth the width of the container opening may be used with the dual flow manifold shown in FIG. 11. It may, however, require tighter control over the flow of controlled environment gas into the chamber to achieve desired performance of the gassing system.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. An apparatus for replacing the existing gaseous environment from open containers moving along a conveyer comprising:

a rail having a length and a width positioned along the conveyer;

an inlet in the rail for receiving controlled environment gas from a source;

a distribution manifold formed in a bottom portion of the rail, the manifold having a length and a width, the manifold longitudinally extending along the length of the rail, the manifold including at least one longitudinally oriented region of flow resistance, the region of flow resistance having a length, a width, and a plurality of openings to allow a controlled environment gas stream to pass through the openings and penetrate into the container and maintain a substantially consistent flow pattern so that an outflowing gas stream is continually replaced by the incoming gas stream while preventing outside environment from contaminating the container, the manifold having a width less than the width of the container opening.

2. The apparatus of claim 1 wherein the width of the manifold is between about 0.250 inch and 1.0 inch.

3. The apparatus of claim 1 wherein the width of the manifold is between about one tenth and one fourth of the width of the container opening.

4. The apparatus of claim 1 wherein the the region of flow resistance comprises at least one screen having a plurality of openings, the openings having a width of about 0.0019 inch.

5. The apparatus of claim 1 wherein the width of the manifold is between about one third and one sixth of the width of the container opening.

6. The apparatus of claim 1 wherein the manifold is covered by a screen having openings sized to provide a substantially laminarized flow.

7. The apparatus of claim 1 wherein the flow region is substantially continuous.

8. The apparatus of claim 1 wherein the flow region has a differential flow resistance across its width for providing a differential flow rate of controlled environment gas into the container.

9. The apparatus of claim 1 further comprising a return gas chamber positioned adjacent longitudinal sides of the rail and receiving gas exiting the container.

10. The apparatus of claim 1 wherein at least one longitudinally oriented region of flow resistance comprises at least one longitudinally oriented region of higher flow resistance and at least one longitudinally oriented region of lower flow resistance.

11. The apparatus of claim 1 wherein the manifold is positioned adjacent the container top.

12. The apparatus of claim 1 further comprising a sidewall positioned along longitudinal sides of the chamber.

13. The apparatus of claim 9 further comprising sidewalls positioned along longitudinal sides of the return gas chambers.

14. The apparatus of claim 1 wherein the rail is at least about as wide as the container opening, and substantially covers the container opening.

15. A method of replacing the existing gaseous environment from open containers moving on a conveyor in a direction of travel, comprising the steps of:

providing a rail having a length and a width positioned along the conveyer, an inlet in the rail for receiving a controlled environment gas from a source; and a distribution manifold formed in a bottom portion of the rail, the manifold having a length and a width, the manifold longitudinally extending along the length of the rail, the manifold including at least one longitudinally oriented region of flow resistance, the region of flow resistance having a length, a width, and a plurality of openings the manifold having a width less than the width of the container opening;

passing the containers along the rail for a period of time; and supplying a flow of controlled environment gas into the containers through the openings of the region of flow resistance, the incoming flow of controlled environment gas penetrating into the container and maintaining a substantially consistent flow pattern so that an outgoing gas flow is continually replaced by the incoming gas flow while substantially preventing outside air from contaminating the container.

16. The method of claim 15 wherein the width of said manifold is less than about one fifth of said width of the container opening.

17. The method of claim 15 wherein supplying a flow comprises supplying a higher velocity stream of controlled environment gas flush through the gas distribution manifold and into the containers through the open tops through a region of lower flow resistance oriented parallel to the direction of travel, while the containers are along the gas distribution manifold, and supplying a stream of lower velocity controlled environment gas blanket through the gas distribution manifold and along the containers, through a region of higher flow resistance oriented parallel to the direction of travel, while the containers are along the gas distribution manifold.

18. The method of claim 15 further comprising receiving gas exiting the container through inlet openings in a return gas chamber positioned along the manifold.

19. The method of claim 15 wherein the manifold is covered by a screen having openings sized to provide a substantially laminarized flow.

20. The method of claim 19 wherein less than 2 percent oxygen remains in the containers after the period of time.

21. The method of claim 15 wherein less than 0.5 percent oxygen remains in the containers after a period of time.

22. The method of claim 15 further comprising a sidewall positioned along the gas distribution manifold.

23. The method of claim 18 further comprising a sidewall positioned along longitudinal sides of the return gas chambers.

24. An apparatus for replacing the existing gaseous environment from containers moving along a conveyor, comprising:

a rail including a length and a width positioned along the conveyer;

an inlet in the rail for receiving controlled environment gas from a source; and a distribution manifold formed in a bottom portion of the rail, the manifold having a length and a width, the manifold longitudinally extending along the length of the rail, the manifold including at least one longitudinally oriented region of flow resistance, the region of flow resistance having a length, a width, and a plurality of openings, the openings having a width of between about 0.0140 and 0.0019 inch to allow a controlled environment gas stream to be passed through the resistance region and penetrate into the container and maintain a substantially consistent flow pattern so that an outflowing gas stream is continually replaced by the incoming gas stream while substantially preventing outside air from contaminating the container, the width of the manifold being less than the width of the container opening.

25. The apparatus of claim 24 wherein the width of the manifold is between about 0.250 inch and 1.0 inch.

26. The apparatus of claim 24 wherein the width of the manifold is between about one tenth and one fourth of the width of the container opening.

27. The apparatus of claim 24 wherein the the region of flow resistance comprises at least one screen, having a plurality of openings, the openings having a width of about 0.0019 inch.

28. The apparatus of claim 24 wherein the width of the manifold is between about one third and one sixth of the width of the container opening.

29. The apparatus of claim 24 wherein the manifold is covered by a screen having openings sized to provide a substantially laminarized flow.

30. The apparatus of claim 24 wherein the flow region is substantially continuous.

31. The apparatus of claim 24 wherein the flow region has a differential flow resistance across its width for providing a differential flow rate of controlled environment gas into the container.

32. The apparatus of claim 24 further comprising a return gas chamber positioned adjacent longitudinal sides of the rail.

33. The apparatus of claim 24 wherein at least one longitudinally oriented region of flow resistance comprises at least one longitudinally oriented region of higher flow resistance and at least one longitudinally oriented region of lower flow resistance.

34. The apparatus of claim 24 wherein the manifold is positioned adjacent the container top.

35. The apparatus of claim 25 further comprising a sidewall positioned along longitudinal sides of the rail.

36. The apparatus of claim 32 further comprising sidewalls positioned along longitudinal sides of the return gas chambers.

37. The apparatus of claim 24 wherein the rail is at least about as wide as the container opening, and substantially covers the container opening.

38. A method of replacing the existing gaseous environment from containers with open tops, moving on a conveyor in a direction of travel, comprising the steps of:

providing a rail having a length and a width positioned along the conveyer, an inlet in the rail for receiving a controlled environment gas from a source; and a distribution manifold formed in a bottom portion of the rail, the manifold having a length and a width, the width of the manifold being less than the width of the container opening the manifold longitudinally extending along the length of the rail, the manifold including at least one longitudinally oriented region of flow resistance, the region of flow resistance having a length, a width, and a plurality of openings;

passing the containers along the gas distribution manifold for a period of time; and supplying a flow of controlled environment gas downward into the containers through the manifold having openings between about 0.0140 and 0.0019 inch, the incoming flow of controlled environment gas penetrating into the container and maintaining a substantially consistent flow pattern so that an outgoing gas flow is continually replaced by the incoming gas flow while substantially preventing outside air from being pulled into the container.

39. The method of claim 38 wherein the width of the manifold is less than about one fifth of the width of the container opening.

40. The method of claim 38 wherein supplying a flow comprises supplying a higher velocity stream of controlled environment gas flush through the gas distribution manifold and into the containers through the open tops through a region of lower flow resistance oriented parallel to the direction of travel, while the containers are along the gas distribution manifold, and supplying a stream of lower velocity controlled environment gas blanket through the gas distribution manifold and along the containers through a region of higher flow resistance oriented parallel to the direction of travel, while the containers are along the gas distribution manifold.

41. The method of claim 38 further comprising receiving gas exiting the container through inlet openings in a return gas chamber positioned along the manifold.

42. The method of claim 38 wherein the manifold is covered by a screen having openings sized to provide a substantially laminarized flow.

43. The method of claim 42 wherein less than 2 percent oxygen remains in the containers after the period of time.

44. The method of claim 38 wherein less than about 0.5 percent of oxygen remains in the containers after the period of time.

45. The apparatus of claim 38 further comprising a sidewall positioned along the manifold.

46. The apparatus of claim 41 further comprising sidewalls positioned along longitudinal sides of the return gas chambers.

47. Apparatus for replacing existing environment within open containers with a controlled environment comprising:

a rail including an inlet pathway and a return gas pathway formed at one longitudinal end of the rail, the inlet pathway communicating with an inlet channel formed within the rail, the return gas pathway communicating with at least one return gas channel formed within the rail, said channels extending longitudinally through the rail, the inlet channel including at least one region of flow resistance within the inlet channel, the region of flow resistance having a length, a width, and a plurality of openings for allowing a substantially continuous flow of controlled environment gas to pass through the inlet pathway and along the inlet channel and through the openings in the region of flow resistance and into a container, to maintain a substantially continuous flow pattern to allow substantially all existing environment within the container to be replaced with the incoming gas, the width of the region of flow resistance being less than the width of the container opening, the gas exiting the container flowing substantially through the return gas channel and through the return gas pathway.

48. The apparatus of claim 47 further comprising screens positioned within and covering the channels.

49. The apparatus of claim 47 wherein the rail has a width at least about 75 percent of the width of the container opening.

50. The apparatus of claim 47 wherein the return gas pathway communicates with two channels positioned on either side of the inlet channel.

* * * * *